US010702085B1

(12) United States Patent
Newport et al.

(10) Patent No.: US 10,702,085 B1
(45) **Date of Patent: *Jul. 7, 2020**

(54) DECK CURTAIN SYSTEM AND METHOD OF USE

(71) Applicant: Deck Dressings, LLC., Bettendorf, IA (US)

(72) Inventors: Cheryl Newport, Davenport, IA (US); David D. Heilman, Geneseo, IL (US)

(73) Assignee: Deck Dressings, LLC., Bettendorf, IA (US)

( * ) Notice: Subject to any disclaimer, the term of this patent is extended or adjusted under 35 U.S.C. 154(b) by 261 days.

This patent is subject to a terminal disclaimer.

(21) Appl. No.: 15/390,476

(22) Filed: Dec. 24, 2016

Related U.S. Application Data

(63) Continuation-in-part of application No. 14/577,147, filed on Dec. 19, 2014, now Pat. No. 9,567,800.

(60) Provisional application No. 61/918,604, filed on Dec. 19, 2013.

(51) Int. Cl.

| | |
|---|---|
| ***A47H 1/142*** | (2006.01) |
| ***A47H 1/122*** | (2006.01) |
| ***A47H 1/022*** | (2006.01) |
| *A47H 1/02* | (2006.01) |
| *E04B 1/00* | (2006.01) |

(52) U.S. Cl.
CPC ..... *A47H 1/122* (2013.01); *A47H 1/022* (2013.01); *A47H 1/142* (2013.01); *A47H 2001/0215* (2013.01); *E04B 1/003* (2013.01)

(58) Field of Classification Search
CPC ..... A47H 1/122; A47H 1/14; A47H 1/142; A47H 1/12; E04B 1/003; E04H 15/34; E04H 15/42; E04H 12/22; E04H 12/2253; E04H 12/2269; E04H 12/2284; E04H 17/1421; E04H 17/1434; E04H 17/1443; E04H 17/1447; E04H 2017/1447
USPC ..... 160/330, 333, 351, 350; 135/90, 120.1, 135/120.2, 120.3; 248/536, 125.7, 125.8
See application file for complete search history.

(56) References Cited

U.S. PATENT DOCUMENTS

| | | | | |
|---|---|---|---|---|
| 443,133 A | | 12/1890 | Connelly | |
| 915,444 A | * | 3/1909 | Kale | A47H 1/022 160/125 |
| 956,983 A | * | 5/1910 | Laun | E06B 9/323 211/123 |
| 1,015,448 A | | 1/1912 | Madden | |

(Continued)

OTHER PUBLICATIONS

Improvements "Railing Curtain Rod and 2 Posts Item #448425" <http://www.improvementscatalog.com/wcsstore/images/Improvements/text/pdf/products/448425-Railing-Curtain-Rod-w2-Post.pdf>.

(Continued)

*Primary Examiner* — Johnnie A. Shablack
(74) *Attorney, Agent, or Firm* — Hamilton IP Law, PC; Jay R. Hamilton; Charles A. Damschen

(57) ABSTRACT

A deck curtain and mounting system using vertical posts attachable to a deck rail or decking to form a structure supporting curtains hung from cross members positioned between the vertical posts to surround or encompass a deck area. The method of shading or securing the privacy of a deck area includes attaching vertical posts to a rail cap of a deck structure surrounding a deck area and attaching rotatable horizontal connectors to the vertical posts so that cross members may be connected between the vertical posts for hanging privacy curtains from the cross members around the deck structure.

10 Claims, 24 Drawing Sheets

(56) References Cited

U.S. PATENT DOCUMENTS 1,147,944 A * 7/1915 Holdensen ..... A47H 1/022 160/125
1,371,524 A 3/1921 Smith, Jr.
1,457,465 A * 6/1923 Sherwin ..... E06B 9/42 160/259
1,884,391 A * 10/1932 Toelle ..... A47H 1/142 160/344
2,014,752 A * 9/1935 Vesey ..... A47H 5/02 160/126
2,104,416 A 1/1938 De Ment
2,323,699 A * 7/1943 Babros ..... A47G 5/04 160/135
2,374,787 A * 5/1945 Spiegel ..... A47K 10/04 211/105.1
2,528,358 A * 10/1950 Grass ..... A47H 1/122 248/222.51
2,745,420 A 5/1956 Zitomer
2,855,037 A * 10/1958 Stiffel ..... E04B 2/7438 15/268
3,077,613 A * 2/1963 Mayer ..... A61G 7/0533 482/139
3,106,931 A 10/1963 Cooper
3,430,908 A * 3/1969 Kowalczyk ..... A47H 1/102 248/265
3,656,494 A 4/1972 Cornett
3,737,048 A * 6/1973 Giroux ..... G09F 1/10 211/182
3,771,767 A 11/1973 Dougherty
3,788,376 A * 1/1974 Mednick ..... A47H 1/142 160/126
4,091,857 A 5/1978 Jacobs
4,094,417 A * 6/1978 Cairnes ..... A47B 47/03 108/192
4,209,099 A * 6/1980 Wickes ..... A47B 61/003 211/105.3
4,300,253 A 11/1981 Anderson
4,314,685 A * 2/1982 Schwan ..... A47B 57/04 108/107
4,427,021 A 1/1984 Cater
4,480,418 A * 11/1984 Ventrella ..... E04B 1/1906 403/171
4,627,210 A * 12/1986 Beaulieu ..... A45B 25/10 135/147
4,683,901 A 8/1987 Mitchell
4,698,117 A 10/1987 Enison
4,794,974 A 1/1989 Melino
4,817,319 A * 4/1989 Vitale ..... G09F 7/18 40/603
4,831,791 A 5/1989 Ball
4,901,484 A 2/1990 Santosuosso
4,923,176 A * 5/1990 Heinz ..... E04H 17/1421 256/21
4,929,116 A * 5/1990 Mahl ..... A47B 43/02 403/263
4,951,440 A * 8/1990 Staeger ..... E04B 1/1909 403/171
5,011,030 A * 4/1991 Alaurent ..... A47H 1/022 211/105.6
5,026,013 A * 6/1991 Robbins ..... A47K 10/10 248/221.12
5,101,607 A * 4/1992 Staeger ..... E04B 1/1909 52/646
5,111,631 A * 5/1992 Flood ..... A47F 5/14 52/646
5,238,321 A * 8/1993 Jarjoura ..... A47B 57/44 256/65.03
5,291,708 A * 3/1994 Johnson ..... E02D 27/01 52/282.2
5,352,149 A 10/1994 Melashenko et al.
5,356,234 A * 10/1994 Vangool ..... E04B 1/1903 403/170
5,415,194 A 5/1995 Kaye
5,415,380 A * 5/1995 Sharp ..... E04H 17/1434 256/22
5,421,394 A 6/1995 Forrest
5,472,102 A 12/1995 Clayton
5,549,408 A * 8/1996 Lo ..... A47B 47/0016 403/171
5,613,543 A 3/1997 Walton
5,626,434 A * 5/1997 Cook ..... E04B 1/1903 403/171
5,680,893 A 10/1997 Neer
5,758,868 A * 6/1998 Shea ..... E01F 7/02 256/12.5
5,791,013 A * 8/1998 Lin ..... A47H 1/122 16/87.2
5,802,798 A * 9/1998 Martens ..... E04B 1/1909 52/653.1
5,875,597 A * 3/1999 Gingrich ..... A47G 5/02 160/135
5,884,725 A 3/1999 Reyland
5,930,971 A * 8/1999 Etheridge ..... E04H 15/34 135/122
5,961,242 A * 10/1999 Leone ..... E04H 17/1421 248/228.1
6,006,811 A 12/1999 Brutsaert
6,032,430 A * 3/2000 Soukup ..... E04B 1/585 403/170
6,142,892 A * 11/2000 Dennis ..... A63B 63/004 248/74.3
6,334,596 B1 * 1/2002 Temple ..... A45F 3/44 248/156
6,341,566 B1 * 1/2002 Hwang ..... A47B 47/005 108/180
6,370,803 B1 * 4/2002 Burquest ..... G09F 15/0025 40/607.04
6,397,537 B2 * 6/2002 Auer ..... E04B 2/744 403/170
6,508,295 B2 * 1/2003 Whittemore ..... A47H 21/00 160/351
6,513,566 B2 2/2003 Larin
6,595,478 B2 * 7/2003 Lee ..... A47H 1/102 248/251
6,676,094 B1 * 1/2004 Brown ..... F16M 13/022 248/214
6,698,725 B1 * 3/2004 Berry ..... E04H 17/066 256/11
6,702,245 B1 * 3/2004 Otterman ..... E04H 12/2276 248/214
6,896,437 B2 * 5/2005 Morgan ..... E04H 17/1421 135/909
6,942,002 B1 9/2005 Williams
7,097,146 B2 * 8/2006 Tsai ..... E04F 15/02458 248/638
7,104,305 B1 * 9/2006 Apollon ..... A47H 1/122 160/339
D533,111 S * 12/2006 Taddia ..... D11/181
7,231,954 B2 6/2007 Green
7,316,237 B2 1/2008 Connelly
7,377,490 B1 * 5/2008 Khosravian ..... E01F 13/028 119/416
7,472,666 B1 1/2009 Richard et al.
7,594,633 B2 9/2009 Carnevali
7,648,111 B2 * 1/2010 Goldstein ..... A47H 1/022 248/200.1
7,673,643 B2 3/2010 Seo
7,703,469 B2 4/2010 Danziger
7,780,371 B2 * 8/2010 Daubner ..... A47B 47/0016 403/171
7,832,454 B2 11/2010 Lyons
7,856,761 B2 12/2010 Heselden
7,896,015 B2 3/2011 Milano et al.
7,948,111 B2 * 5/2011 Nigam ..... F03D 3/005 248/125.7
8,056,873 B1 * 11/2011 Hanley ..... A47H 1/022 248/261
8,231,093 B2 * 7/2012 Tran ..... A47H 1/142 16/87.2
8,393,343 B2 3/2013 VanVonderen

(56) References Cited

U.S. PATENT DOCUMENTS 8,783,661 B1 * 7/2014 Payne ..... E04H 17/161 256/49
8,950,723 B1 2/2015 Fogelstrom et al.
8,973,645 B1 * 3/2015 Cannova ..... E01F 7/00 160/351
9,049,952 B2 * 6/2015 Amos ..... E06B 9/24
9,211,027 B2 * 12/2015 Ovist ..... A47H 1/04
9,410,660 B2 * 8/2016 Zimmerman ..... F16M 13/02
9,512,633 B2 * 12/2016 Marron ..... E04H 17/1421
9,567,800 B1 * 2/2017 Newport ..... E06B 9/24
9,717,361 B2 * 8/2017 Amos ..... A47H 1/022
10,006,221 B1 * 6/2018 Payne ..... E04H 17/161
10,051,959 B1 * 8/2018 Glidewell ..... A47B 61/02
10,070,748 B2 * 9/2018 Hanley ..... A47H 1/142
10,087,651 B2 * 10/2018 Cavanagh ..... E04H 17/163
10,123,636 B2 * 11/2018 Nicolopulos ..... A47F 5/02
2001/0022217 A1 9/2001 Larin
2002/0059770 A1 * 5/2002 Fritsche ..... G09F 15/0062 52/645
2002/0178998 A1 * 12/2002 Okumura ..... G09F 17/00 116/174
2003/0094827 A1 5/2003 Faludy et al.
2005/0230067 A1 10/2005 Jordan et al.
2006/0201636 A1 * 9/2006 Morrison ..... A47H 1/122 160/123
2007/0034758 A1 2/2007 Bates
2007/0108363 A1 5/2007 Metheny
2007/0235068 A1 10/2007 Green
2007/0235151 A1 10/2007 Stull
2008/0000504 A1 1/2008 Snyder et al.
2008/0029748 A1 * 2/2008 Ford ..... E04H 17/1413 256/65.03
2008/0283106 A1 11/2008 Heselden
2009/0101609 A1 * 4/2009 Batshon ..... A47H 1/022 211/105.3
2009/0212176 A1 * 8/2009 Cass ..... A47J 47/16 248/125.8
2010/0181445 A1 * 7/2010 Goldstein ..... A47H 1/022 248/205.1
2013/0008617 A1 1/2013 Rivera
2013/0206198 A1 * 8/2013 Kouzmanoff ..... E04H 15/34 135/121
2013/0233365 A1 9/2013 Loos
2014/0030009 A1 * 1/2014 Kreller ..... E04G 7/307 403/246
2014/0075851 A1 3/2014 Rhines et al.
2014/0116488 A1 5/2014 Mallookis et al.
2015/0191931 A1 * 7/2015 Li ..... E04H 15/48 135/147
2016/0040477 A1 2/2016 Seuberling et al.
2016/0095460 A1 * 4/2016 Ovist ..... A47H 1/04 248/263
2016/0108638 A1 4/2016 Loos
2017/0071390 A1 * 3/2017 Moss ..... A47H 1/142
2017/0089059 A1 * 3/2017 Farre Berga ..... E04B 1/24
2018/0163429 A1 * 6/2018 Rosicki ..... E04H 17/1443
2018/0199747 A1 * 7/2018 Moss ..... A47H 1/142

OTHER PUBLICATIONS

Improvements "Railing Curtain Rod and 2 Posts" <http://www.improvementscatalog.com/ railing-curtain-rod-and-2-posts/318909>.

* cited by examiner

DECK CURTAIN SYSTEM AND METHOD OF USE

CROSS REFERENCE TO RELATED APPLICATIONS

This application claims priority from and is a continuation-in part of non-provisional U.S. patent application Ser. No. 14/577,147 filed on Dec. 19, 2014 which claimed priority from provisional U.S. Pat. App. No. 61/918,604 filed on Dec. 19, 2013, all of which are incorporated by reference herein in their entireties.

FIELD OF THE INVENTION

The present disclosure relates to a structure and method of placement of curtains, shades or sheers upon and around an outdoor deck for privacy and/or as a sunscreen.

STATEMENT REGARDING FEDERALLY SPONSORED RESEARCH OR DEVELOPMENT

No federal funds were used to develop or create the invention disclosed and described in the patent application.

REFERENCE TO SEQUENCE LISTING, A TABLE, OR A COMPUTER PROGRAM LISTING COMPACT DISK APPENDIX

Not Applicable.

AUTHORIZATION PURSUANT TO 37 C.F.R. § 1.171 (D)(C)

A portion of the disclosure of this patent document may contain material that is subject to copyright and trademark protection. The copyright owner has no objection to the facsimile reproduction by anyone of the patent document or the patent disclosure, as it appears in the Patent and Trademark Office patent file or records, but otherwise reserves all copyrights whatsoever.

DETAILED DESCRIPTION—BRIEF DESCRIPTION OF DRAWINGS

Figure 6:
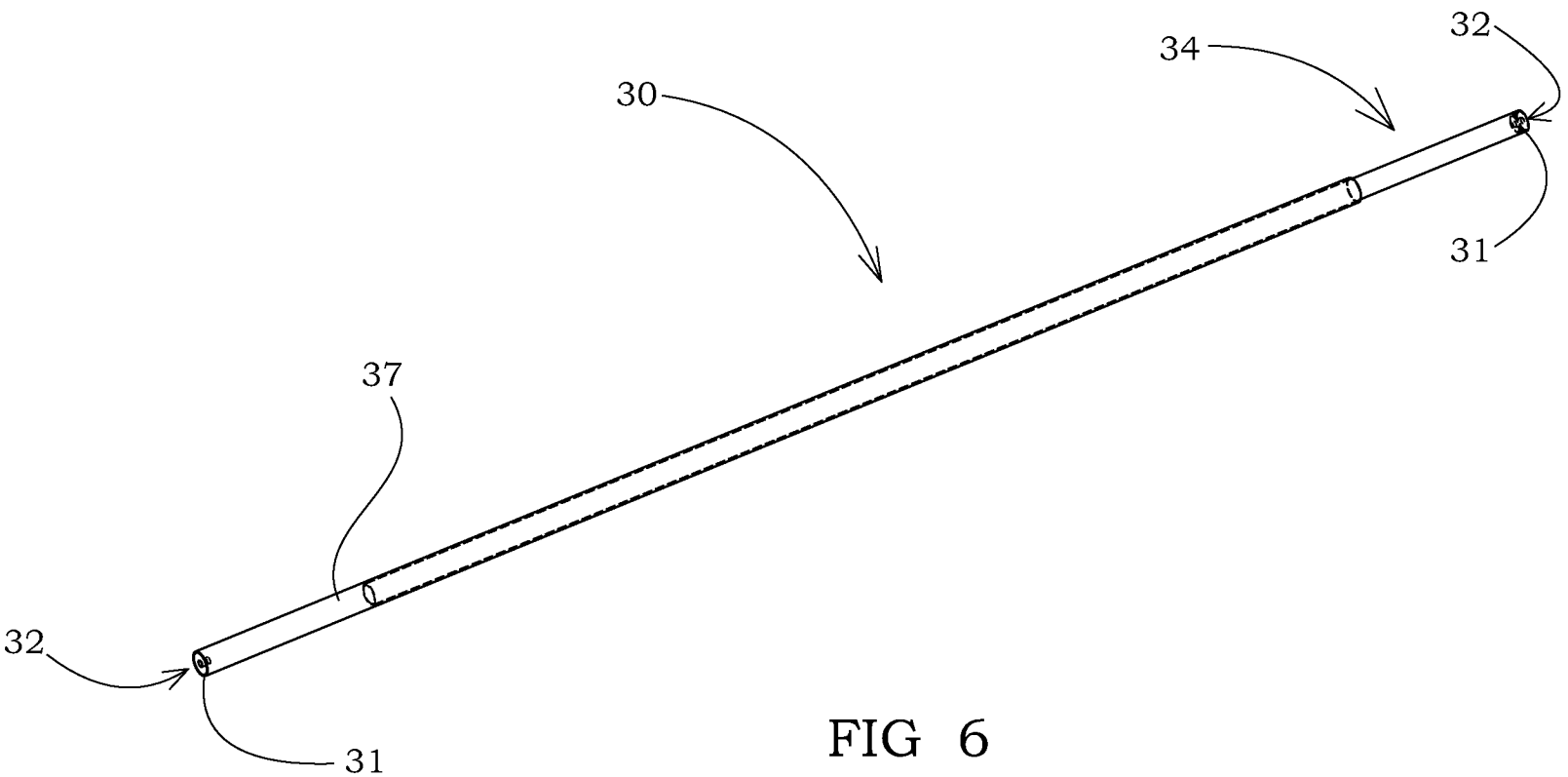

FIG. 6 is a detailed view of another illustrative embodiment of a horizontal rod 30 having a center portion 32 allowing length adjustment via telescoping ends 34 for use with the deck curtain system 10 disclosed herein.

Figure 7:
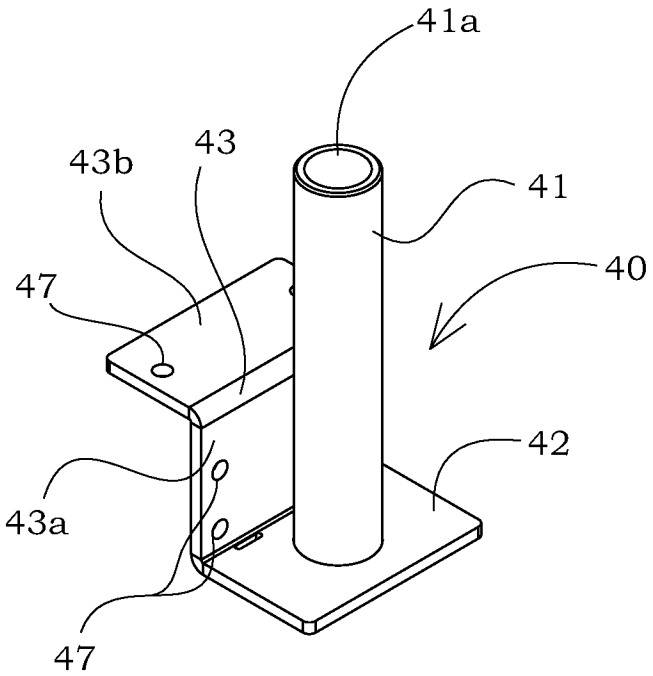

FIG. 7 is a detailed view of one illustrative embodiment of a mounting base 40 for use with vertical post 20 and the rail cap of the deck rail 8.

Figure 7A:
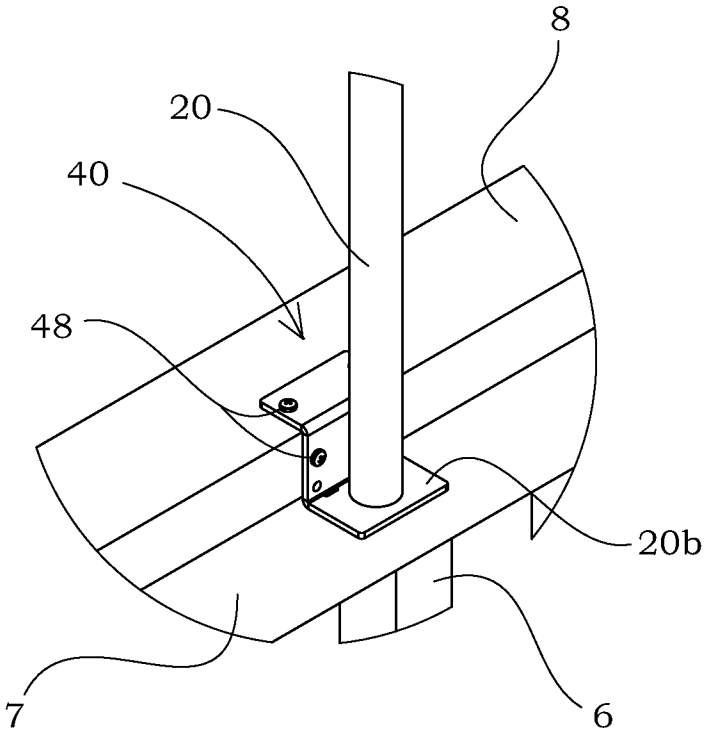

FIG. 7A is a detailed view of the embodiment of FIG. 7 attached to the rail cap 8.

Figure 8:
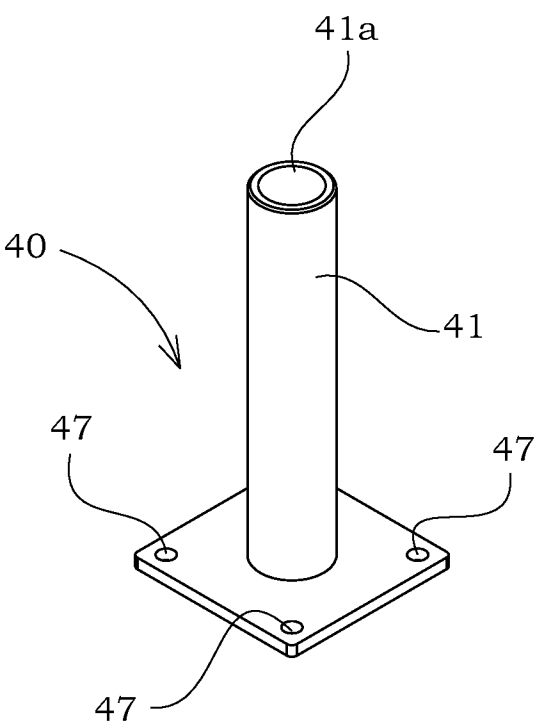

FIG. 8 is a detailed view of another illustrative embodiment of a mounting base 40 for use with vertical post 20 and the rail cap of the deck rail 8.

Figure 8A:
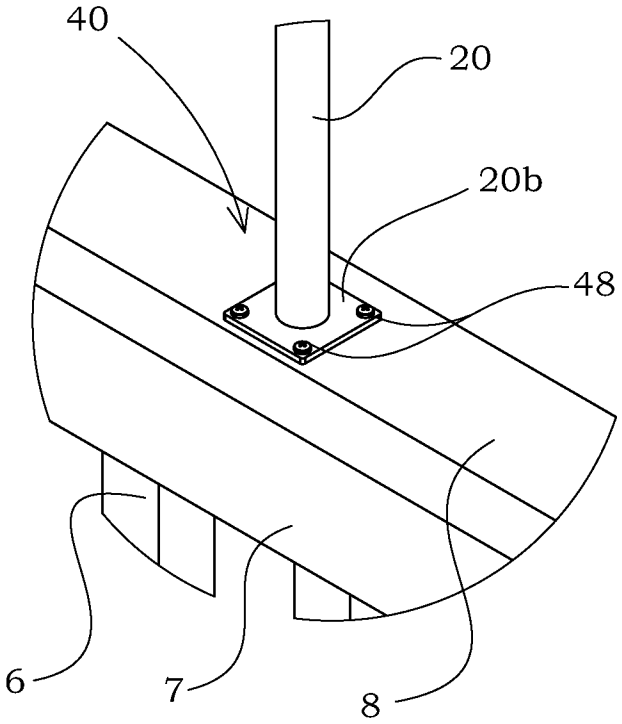

FIG. 8A is a detailed view of the embodiment of FIG. 8 attached to the rail cap 8.

Figure 9:
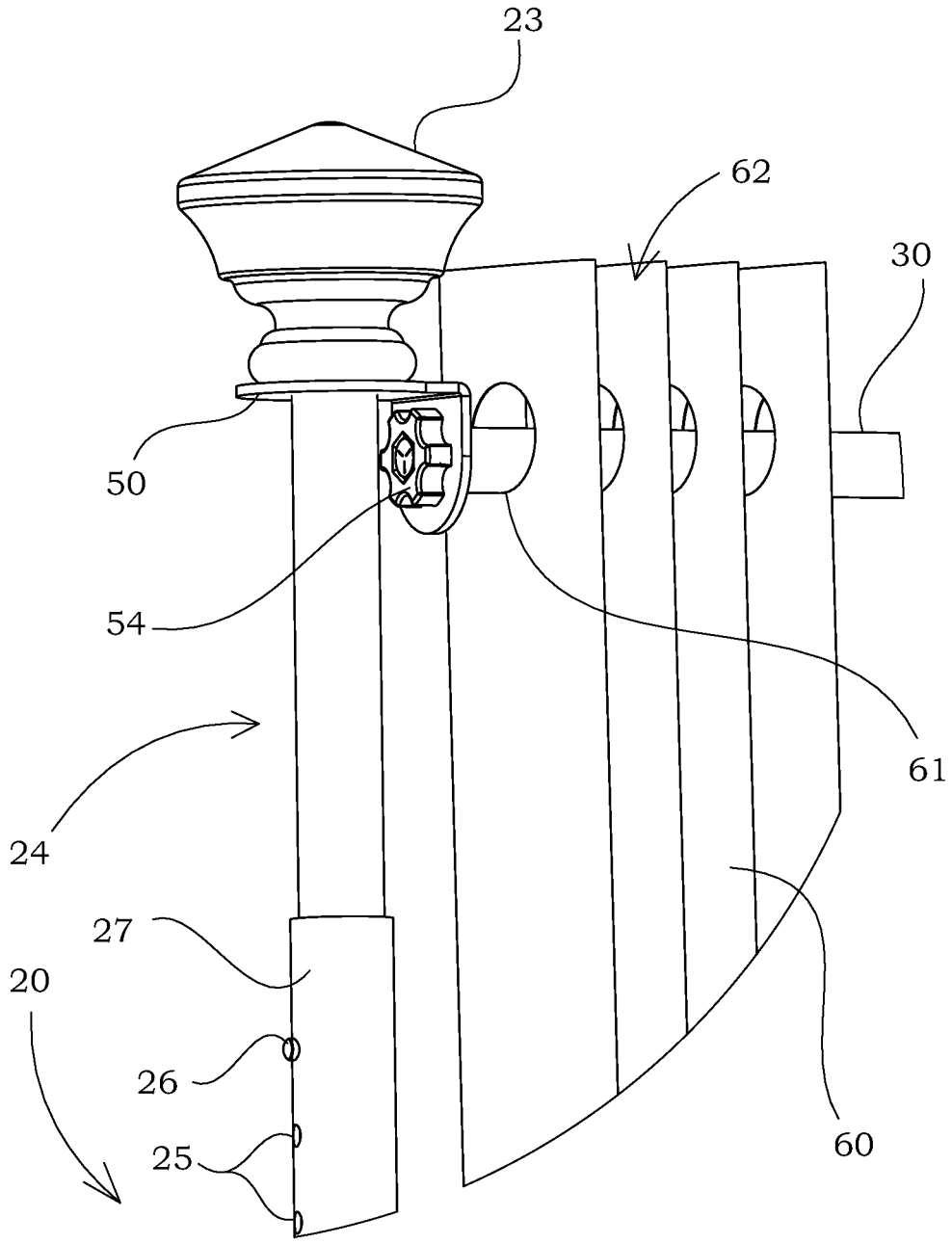

FIG. 9 is a perspective view of one illustrative embodiment of a horizontal connector 50 useful connecting in multiple sections of horizontal orientated cross bars 30 to vertical posts 20 to support the deck system 10.

Figure 9A:
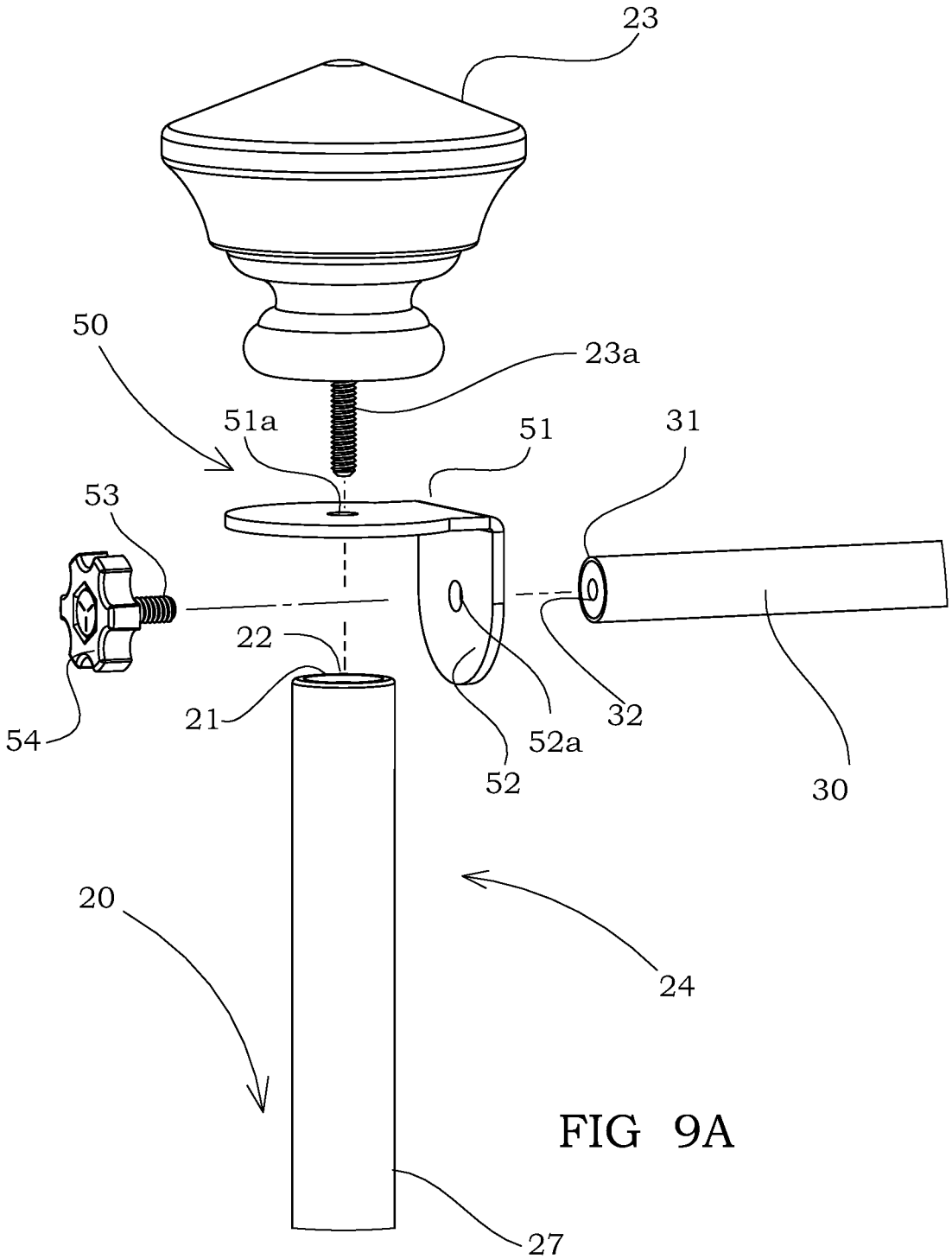

FIG. 9A is an exploded view of the horizontal connector 50 of FIG. 9.

Figure 9B:
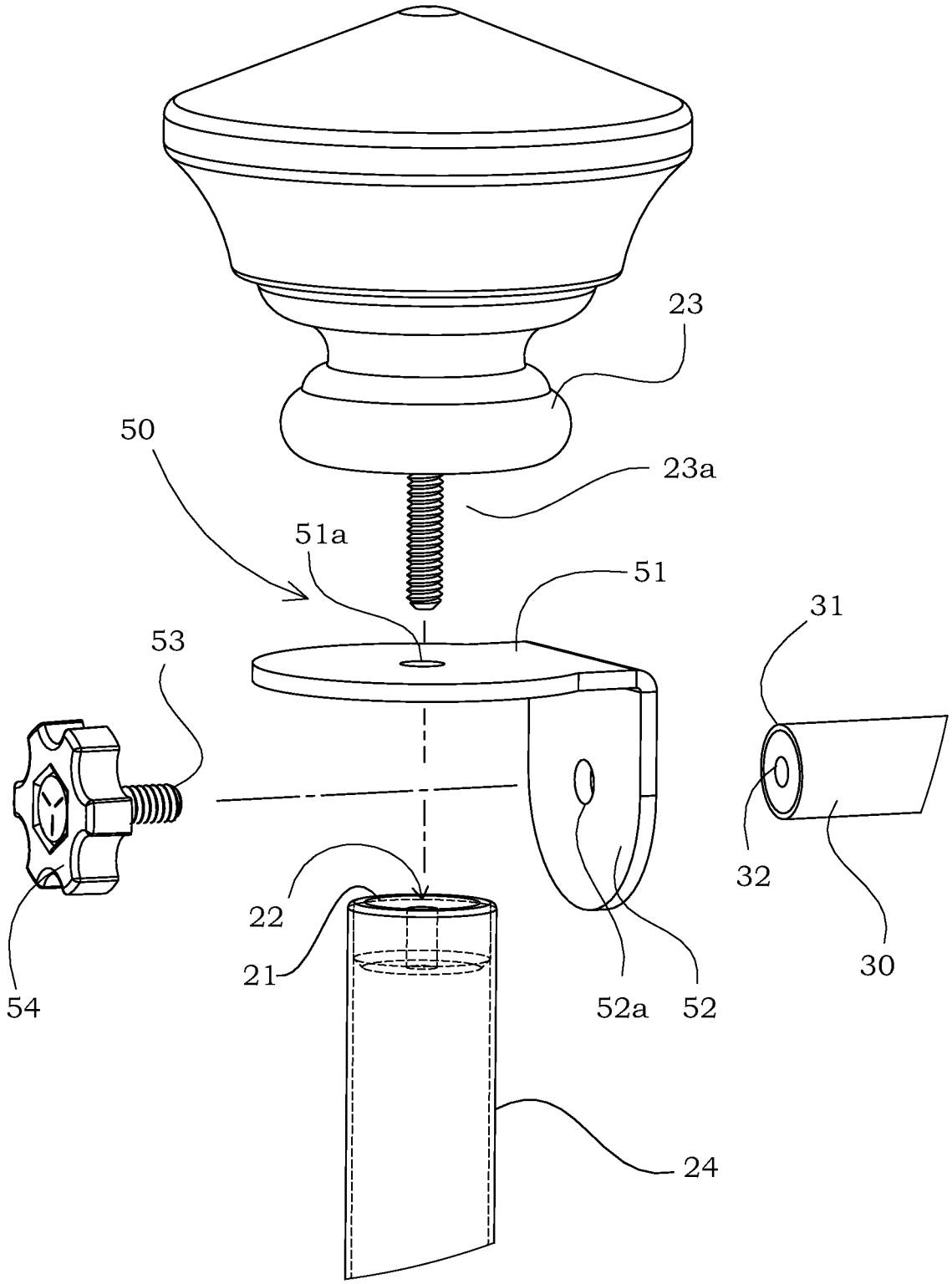

FIG. 9B is a detailed view of horizontal connector 50 of FIG. 9.

Figure 10A:
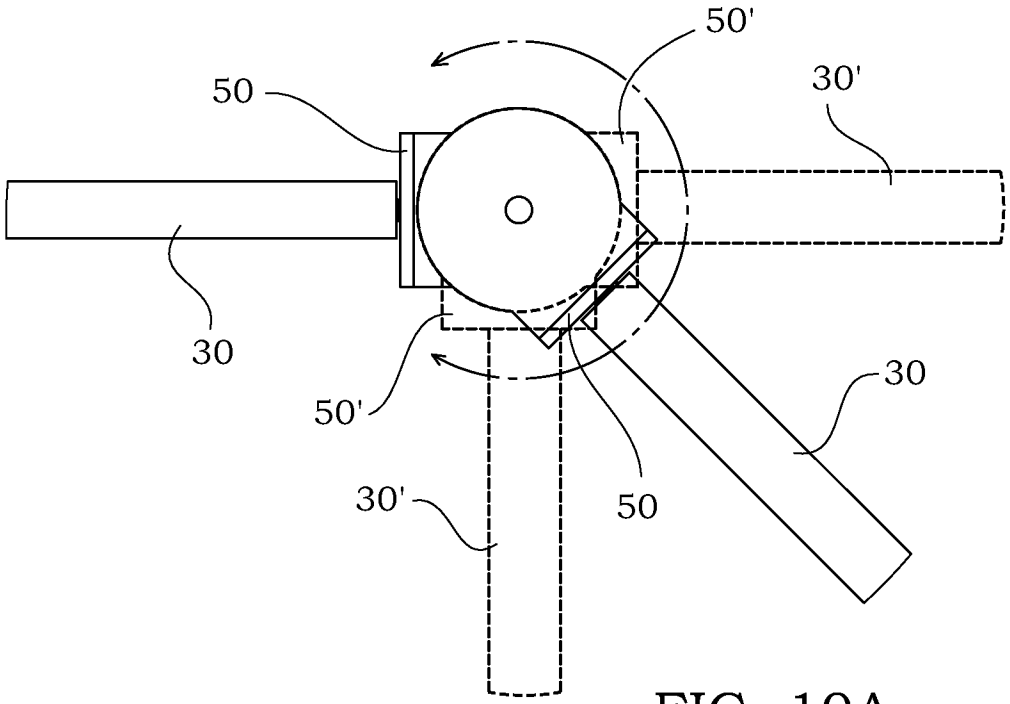
Figure 10:
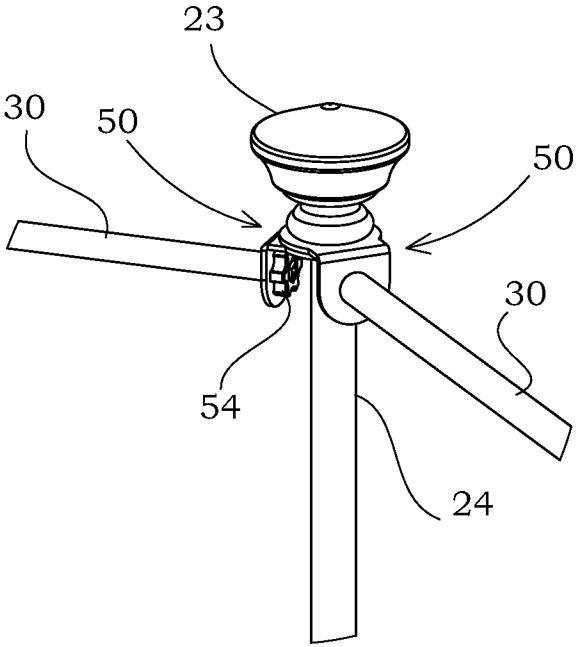

FIG. 10 is a perspective view of the top portion of a vertical post having a pair of horizontal connectors 50 engaged therein.

FIG. 10A is a top view illustrating how multiple horizontal connectors 50 may be positioned upon the portion of the vertical post 20 and then rotated to an angle suitable for cross member (curtain rod) 40.

Figure 11:
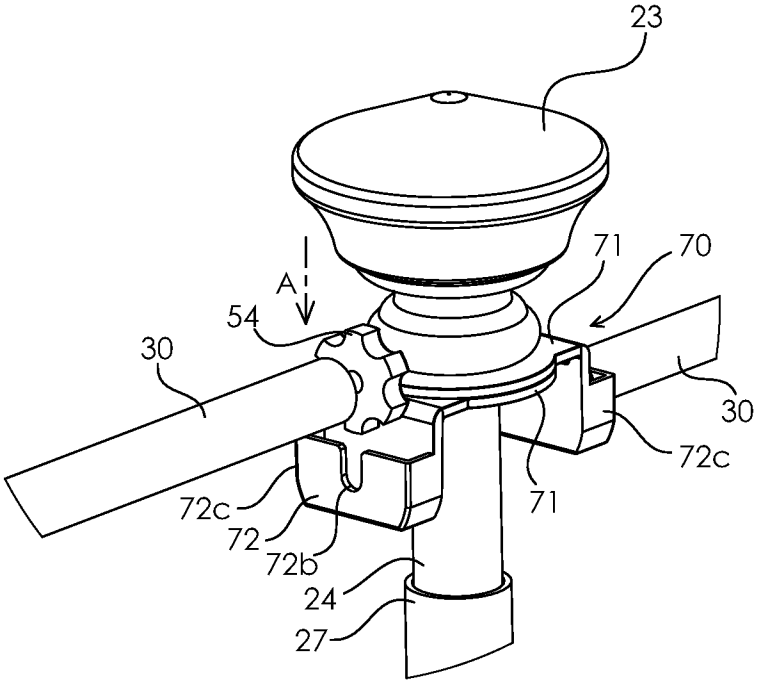

FIG. 11 is another embodiment of a horizontal connector 70 configured with a pocket 72 for enclosure and engagement with knob 54.

Figure 12:
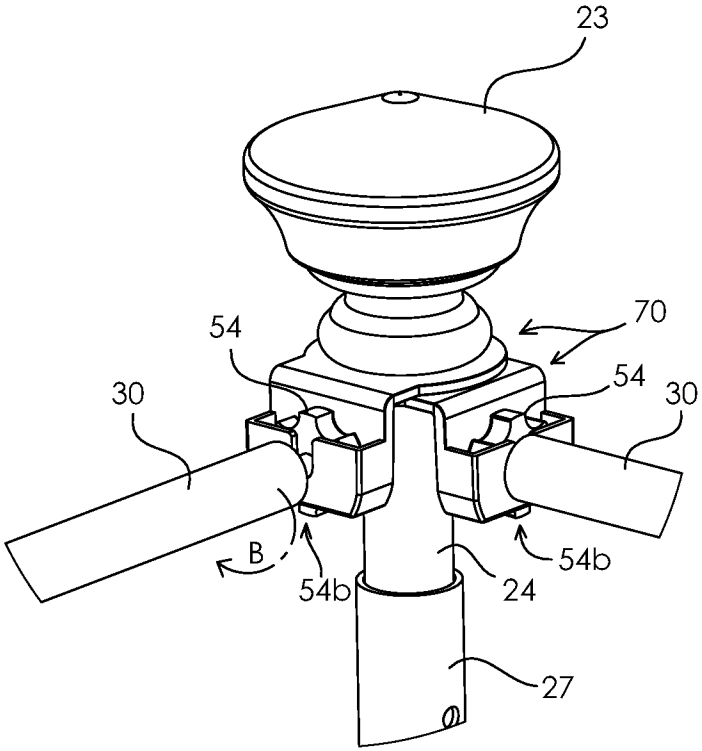

FIG. 12 is another view of the embodiment of FIG. 11 illustrating rotating the cross member 30 to tighten the curtain rod 30 to the pole 24. Also as shown in FIG. 12, multiple pocket style horizontal connectors 70 may be attached (stacked) to a single pole 24 to allow for attachment of multiple curtain rods 24 at various positions around the perimeter of the pole 24.

Figure 13A:
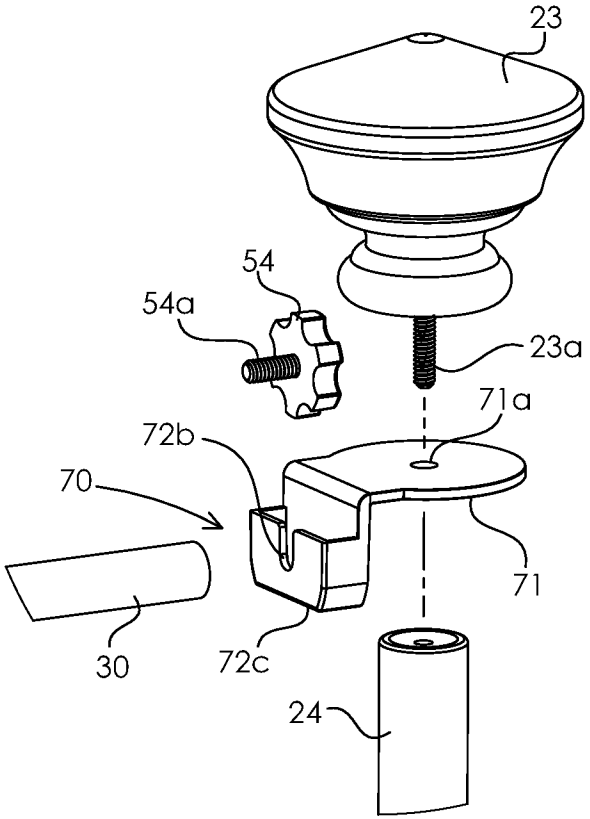
Figure 13:
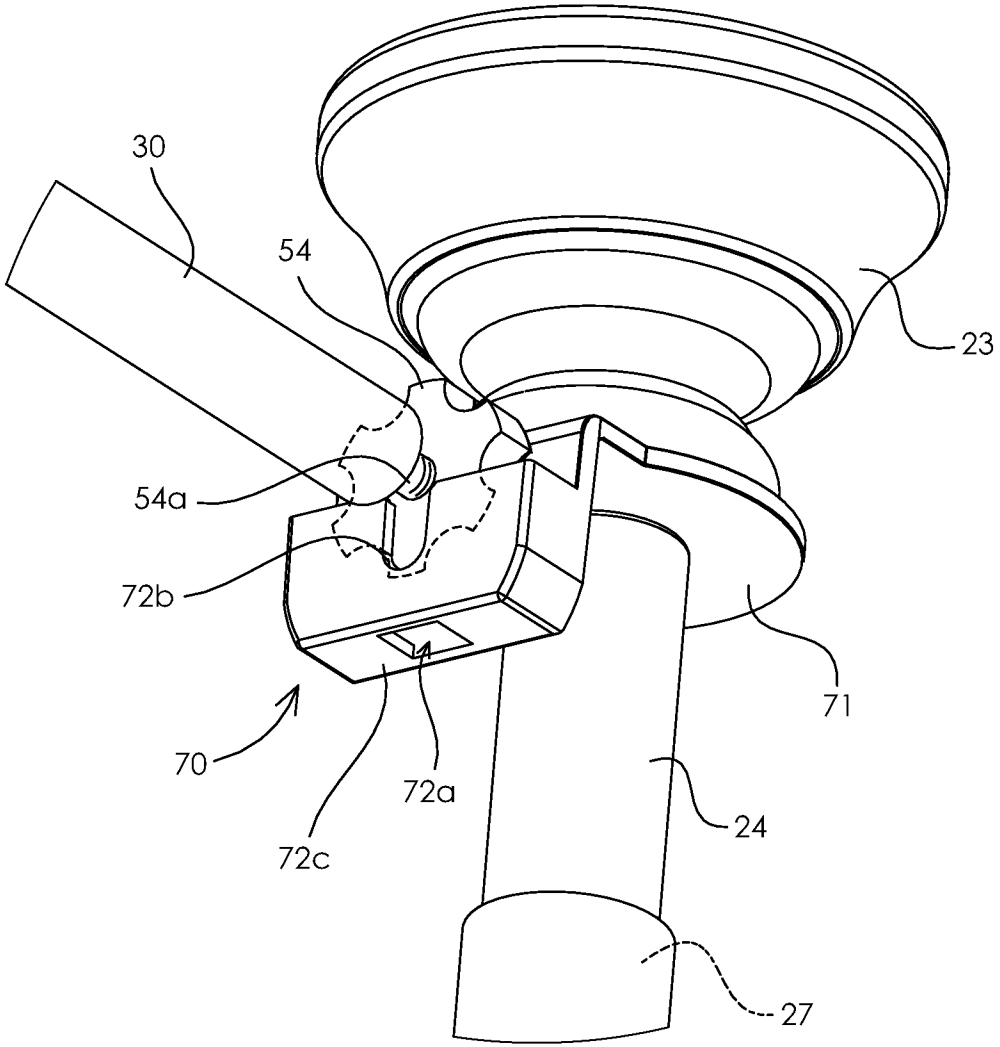

FIG. 13 is a bottom perspective view of the embodiment of FIG. 11 prior to insertion of the knob 54 into the pocket 72 of the horizontal connector 70.

FIG. 13A is an exploded view of the pocket style horizontal connector 70 engaged with pole 24 and cross member 30 via knob 54.

Figure 14:
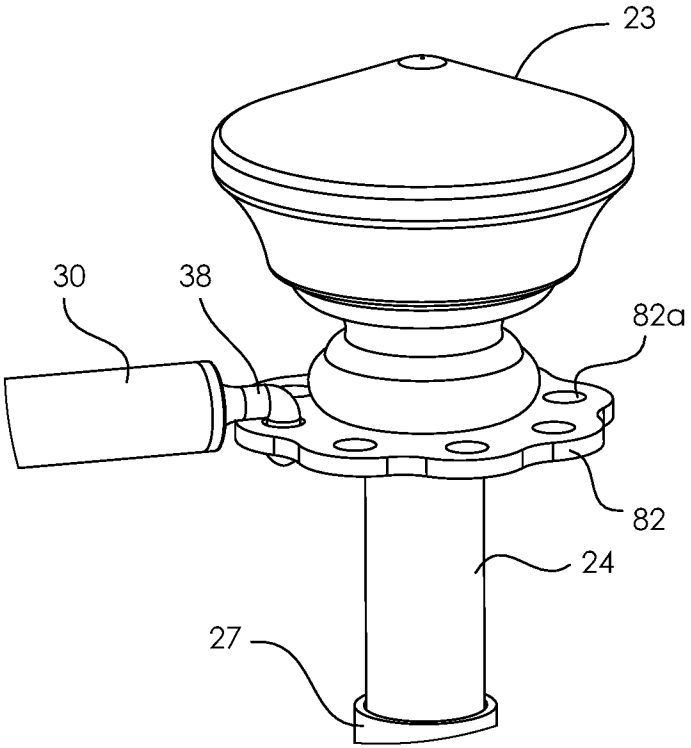

FIG. 14 illustrates another embodiment of a horizontal connector (rosette style) 80 allowing connection between a curtain rod 30 and a pole 24.

Figure 15:
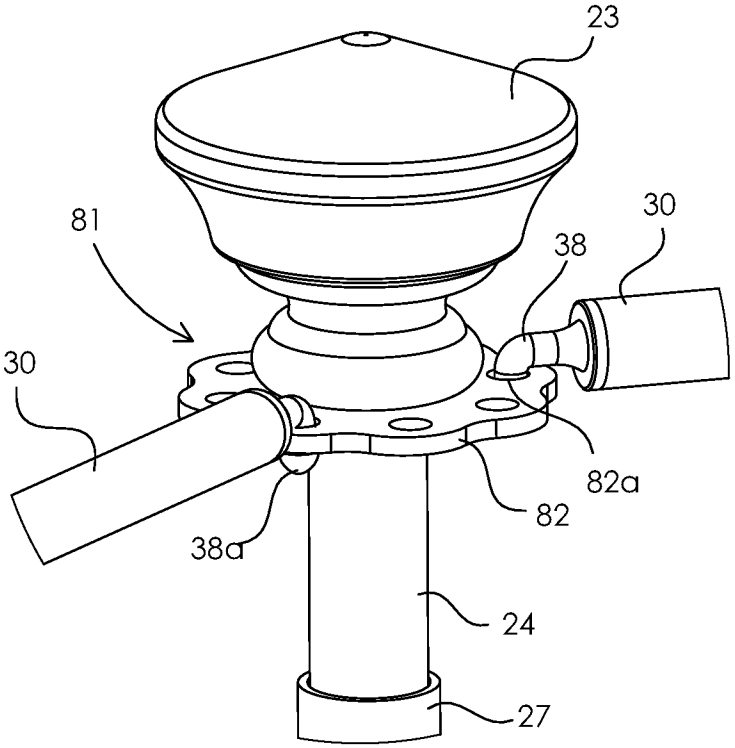

FIG. 15 is another view of the embodiment of FIG. 14 illustrating a single rosette style horizontal connector 80 attaching a single pole 24 to multiple curtain rods 24 at various positions around the perimeter of the pole 24 via horizontal connector 80.

Figure 16:
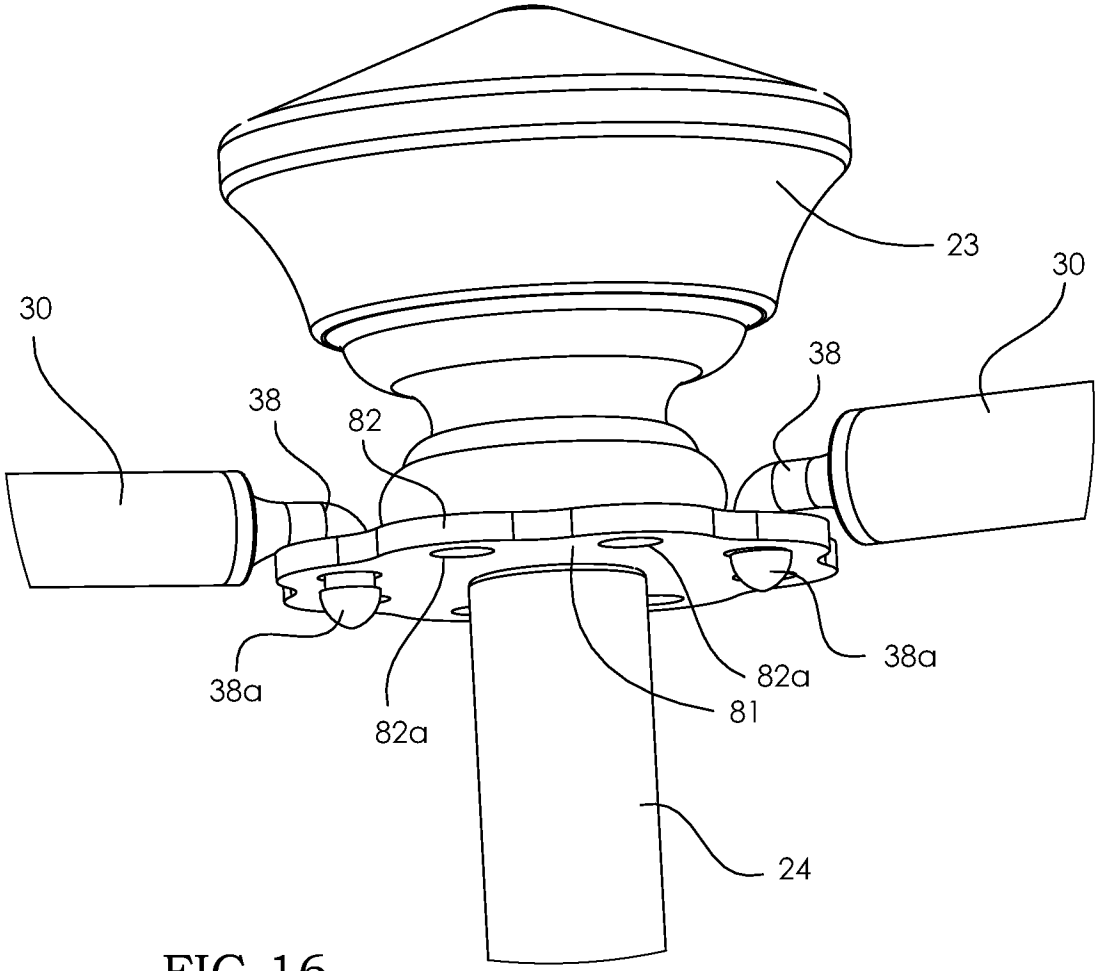

FIG. 16 is a bottom perspective view of the embodiment of FIG. 14 with multiple curtain rods 30 attached around the perimeter of pole 24.

Figure 17:
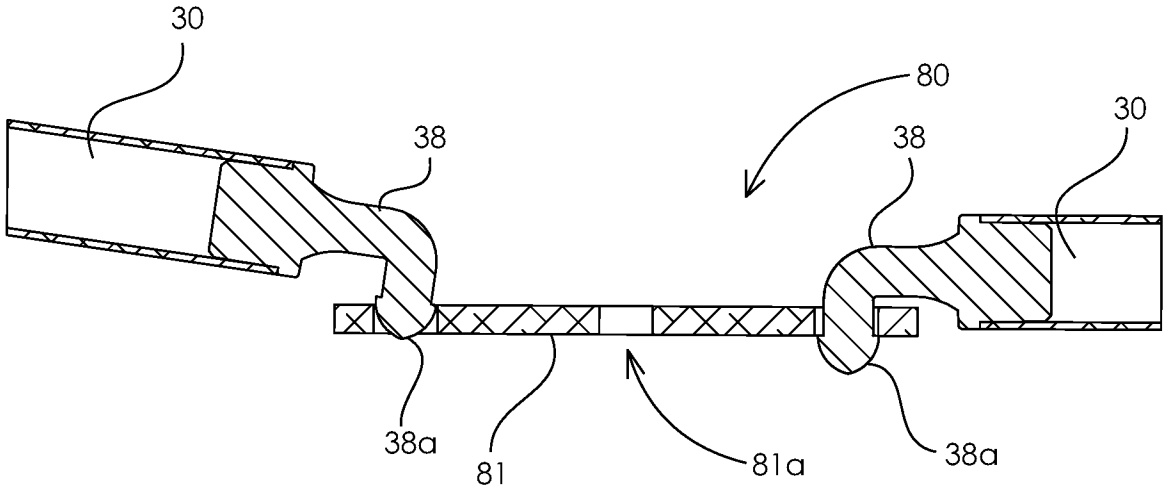

FIG. 17 is a side cutaway view of the rosette style horizontal connector 80 embodiment as shown in FIGS. 14-16 providing particular detail of the curtain rod hooked ends 38 engaging with the apertures of the horizontal connector 80.

Figure 18:
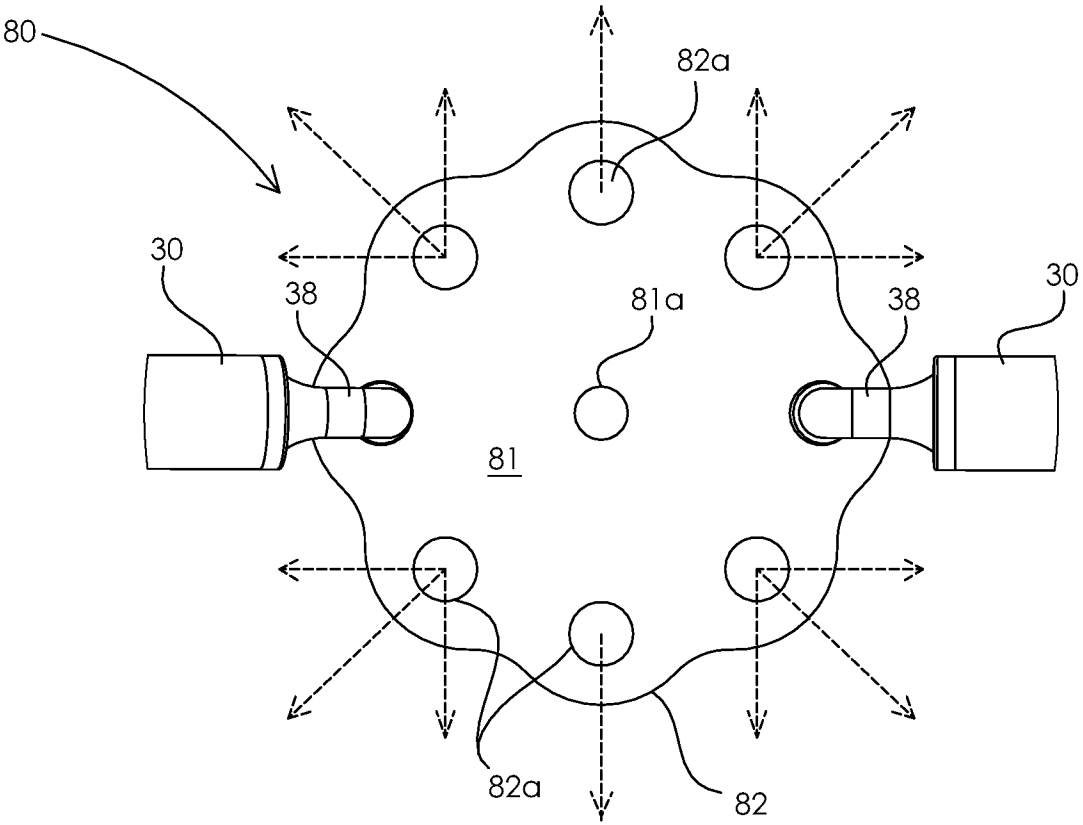

FIG. 18 top view of the horizontal connector 80 of FIGS. 14-17 with hooked curtain rod ends 38 engaged therein.

Figure 19:
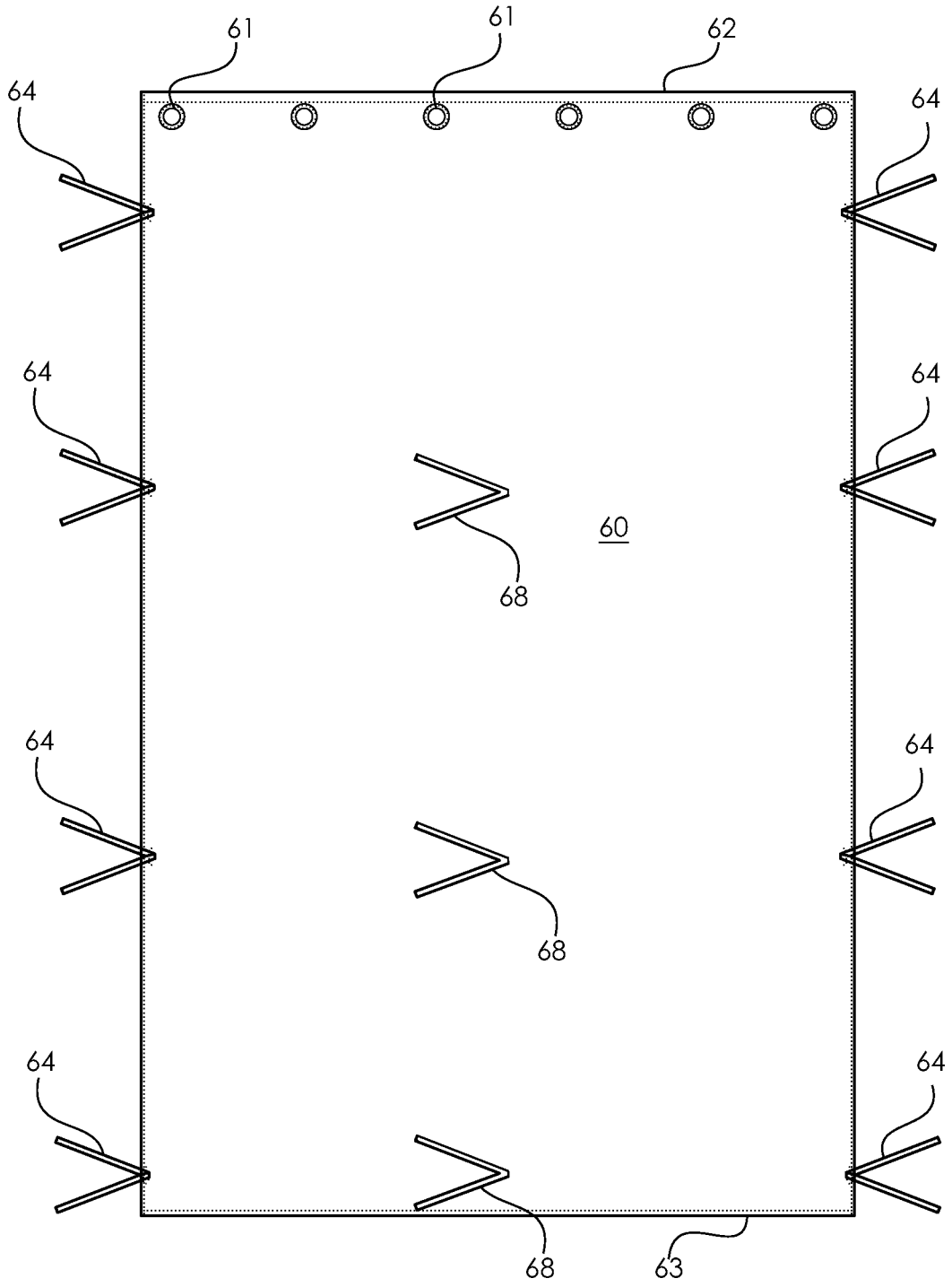

FIG. 19 curtain showing curtain stays 64.

Figure 20:
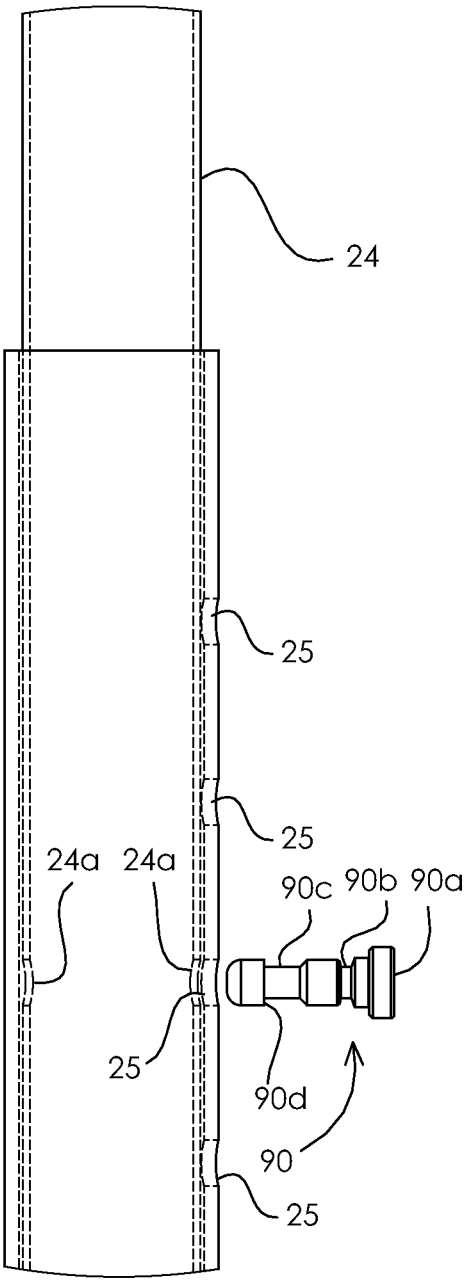

FIG. 20 is a latch pin 90 positioned exterior of the aperture of vertical post 20.

Figure 21:
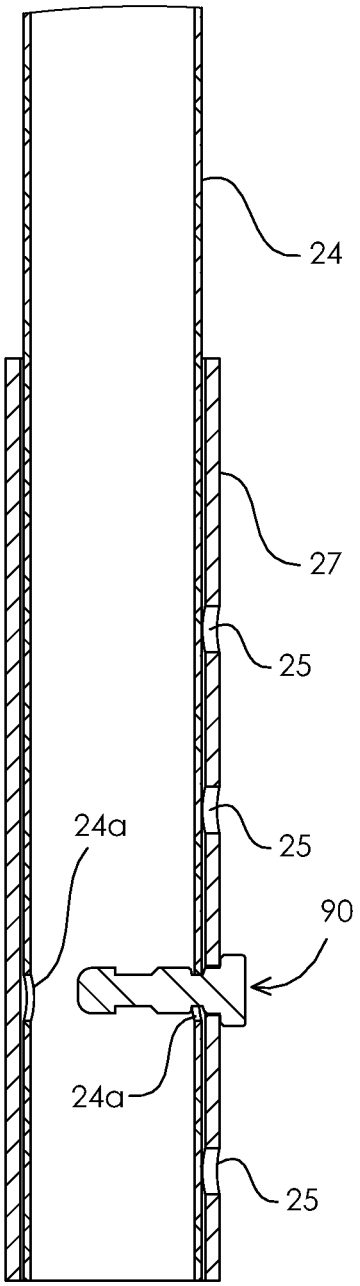

FIG. 21 is a latch pin 90 in a locked position in the hole 25 of the vertical post 20 which passes through the aperture 24*a* of the adjustable (inner) tube 24.

Figure 22:
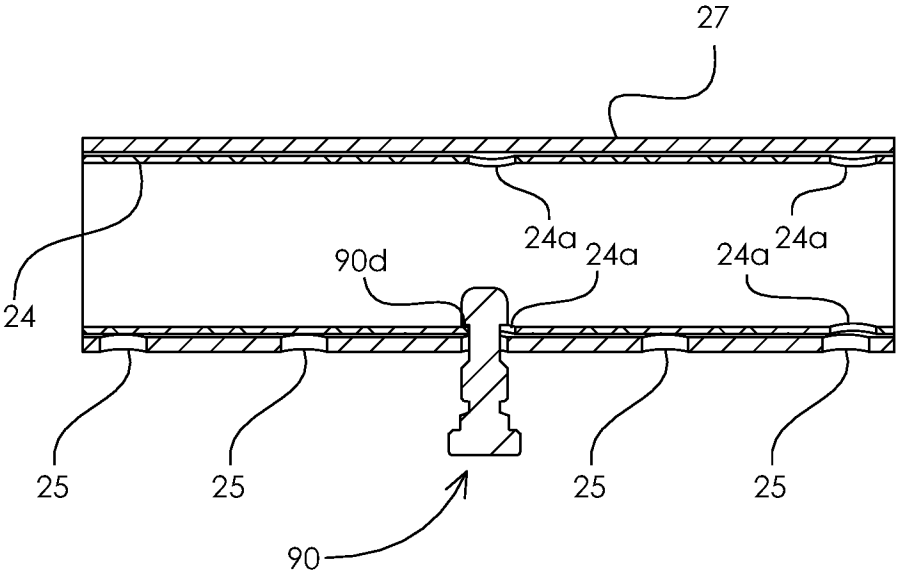

FIG. 22 is a latch pin 90 in a locked position in the hole 25 of the vertical post 20, horizontally positioned, which passes through the aperture 24*a* of the adjustable (inner) tube 24.

Figure 23:
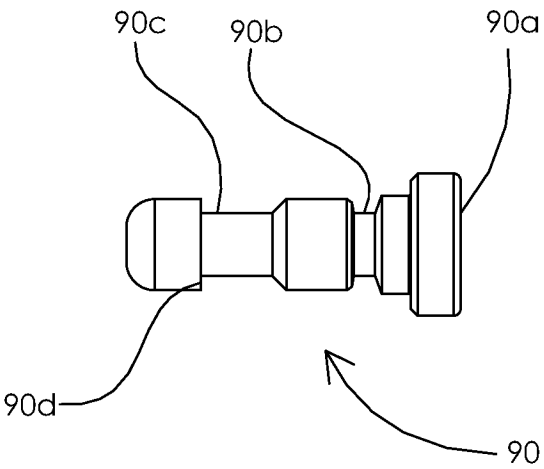

FIG. 23 is a detailed figure of the latch pin 90 illustrating the design of the respective diameters of the first and second annular grooves (90*b*/90*c*).

Figure 24:
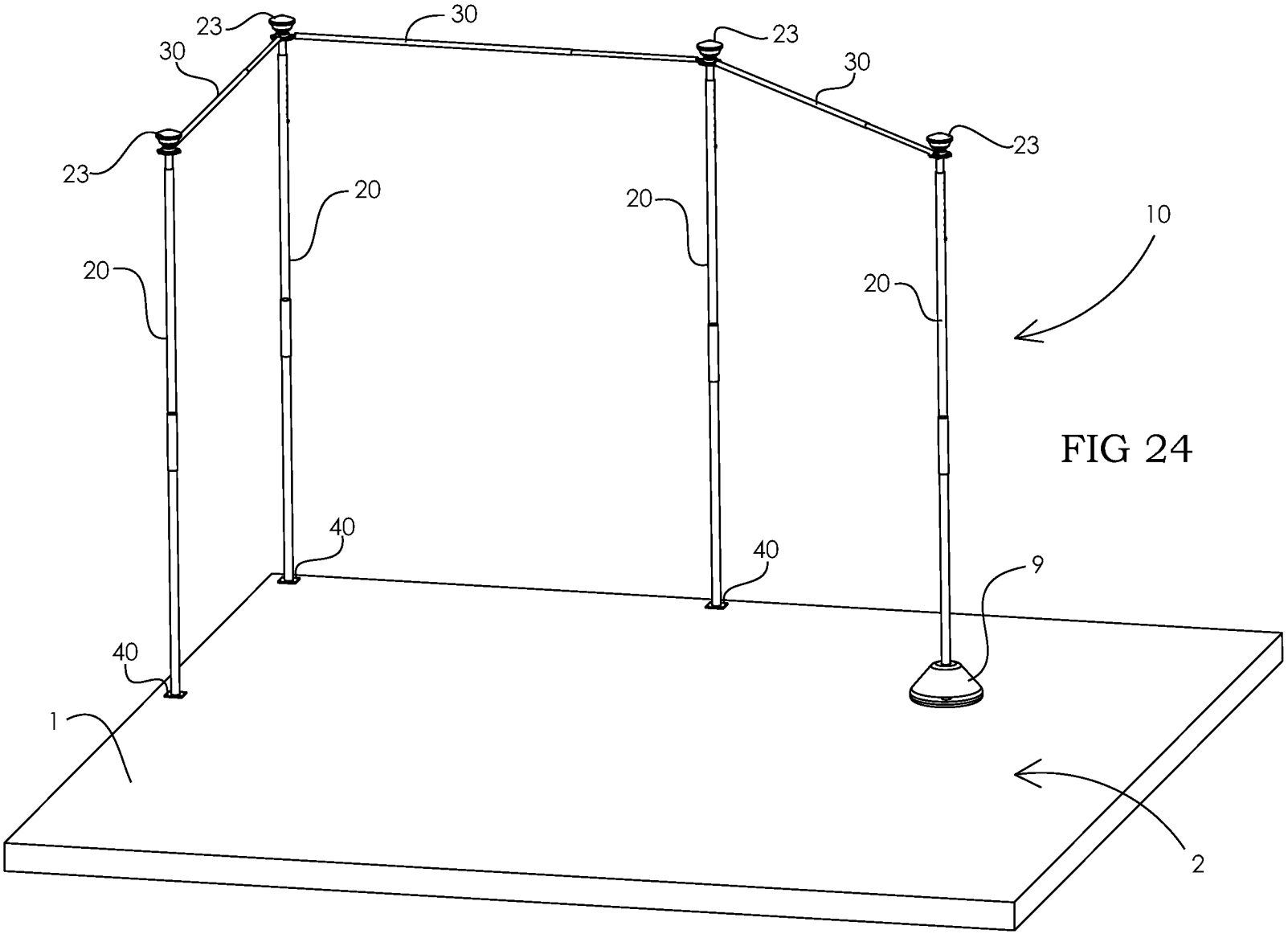

FIG. 24 is a simple figure illustrating another embodiment of the deck curtain system 10 with vertical posts 20 both affixed to the deck 1 and engaged with a self-supporting weighted base 9.

DETAILED DESCRIPTION - LISTING OF ELEMENTS

| Element Description | Element Number |
|---|---|
| Deck | 1 |
| Deck area | 2 |
| Decking | 3 |
| Decking member | 3a |
| Gap | 3b |
| Joist | 4 |
| Rail post | 5 |
| Picket | 6 |
| Horizontal members | 7 |
| Rail cap | 8 |
| Weight base (self-supporting) | 9 |
| Deck curtain system | 10 |
| Vertical post | 20 |
| Open end | 20a |
| Base end | 20b |
| End cap | 21 |
| Opening (threaded) | 22 |
| Finial | 23 |
| Threaded post | 23a |
| Adjustable section | 24 |
| Inside holes of the inner tube | 24a |
| Holes | 25 |
| Spring button latch | 26 |
| Main section | 27 |
| Cross bar (curtain rod) | 30 |
| Open end | 30a |
| End cap | 31 |
| Opening (threaded) | 32 |
| Telescoping end section | 34 |
| Main section | 37 |
| Hooked ends | 38 |
| Bulbous tip | 38a |
| Mounting base | 40 |
| Receiver | 41 |
| Opening | 41a |
| Base | 42 |
| Hanger | 43 |
| Vertical section | 43a |
| Horizontal shelf | 43b |
| Aperture | 47 |
| Fastener | 48 |
| Horizontal connector | 50 |
| Mount | 51 |
| Mount aperture | 51a |
| Flap | 52 |
| Flap aperture | 52a |
| Knob | 54 |
| Knob threaded portion | 54a |
| Knob perimeter | 54b |
| Curtain | 60 |
| Curtain entry-sleeve | 61 |
| Curtain top | 62 |
| Curtain bottom | 63 |
| Curtain stays | 64 |
| Horizontal connector - pocket style | 70 |
| Mount portion | 71 |
| Mount aperture | 71a |
| Pocket portion | 72 |

-continued

DETAILED DESCRIPTION - LISTING OF ELEMENTS

| Element Description | Element Number |
|---|---|
| Pocket aperture | 72a |
| Pocket slots | 72b |
| Pocket wall | 72c |
| | 73 |
| Horizontal connector - rosette style | 80 |
| Mount portion | 81 |
| Mount aperture | 81a |
| Perimeter | 82 |
| Perimeter aperture | 82a |
| Latch pin | 90 |
| Cap | 90a |
| Second ($2^{nd}$) annular groove | 90b |
| First ($1^{st}$) annular groove | 90c |
| Conical tip | 90d |

DETAILED DESCRIPTION OF INVENTION

Before the various embodiments of the present invention are explained in detail, it is to be understood that the invention is not limited in its application to the details of construction and the arrangements of components set forth in the following description. The invention is capable of other embodiments and of being practiced or of being carried out in various ways. Also, it is to be understood that phraseology and terminology used herein with reference to device or element orientation (such as, for example, terms like "front", "back", "up", "down", "top", "bottom", and the like) are only used to simplify description of the present invention, and do not alone indicate or imply that the device or element referred to must have a particular orientation. In addition, terms such as "first", "second", and "third" are used herein and in the appended claims for purposes of description and are not intended to indicate or imply relative importance or significance.

The following detailed description is of the best currently contemplated modes of carrying out illustrative embodiments of the invention. The description is not to be taken in a limiting sense, but is made merely for the purpose of illustrating the general principles of the invention, since the scope of the invention is best defined by the appending claims. Various inventive features are described below herein that can each be used independently of one another or in combination with other features.

Illustrative Embodiment and Advantages of Invention

Figure 1:
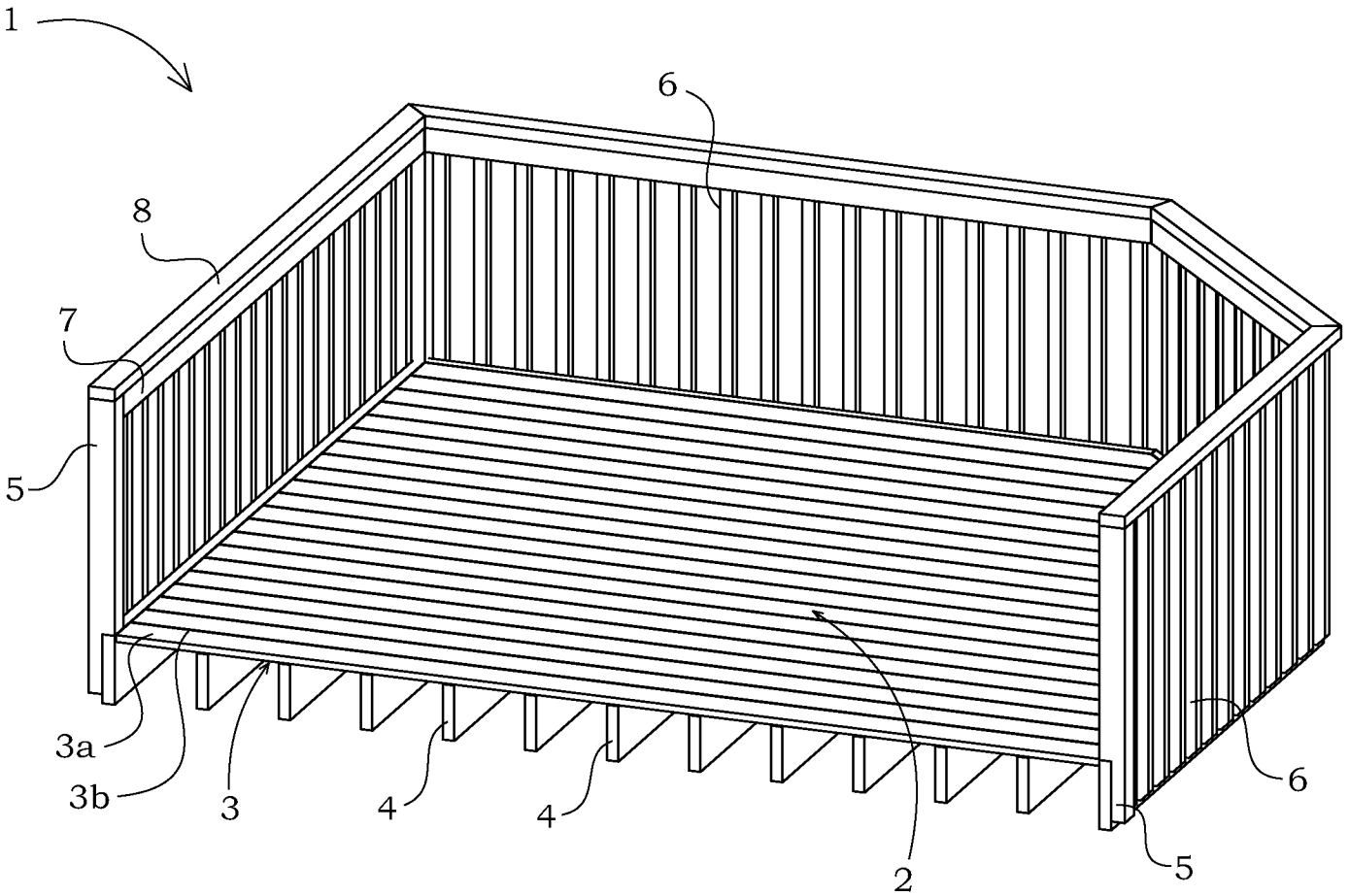
FIG. 1 is a perspective view of a deck 1 a surrounding an exterior space as may be attached to a residential home or apartment of the prior art.

FIG. 1 is a perspective view of a deck 1 a surrounding an exterior space as may be attached to a residential home or apartment of the prior art. The deck 1 of FIG. 1 is illustrative of those well known to those of ordinary skill in the art constructed with adjacent decking members 3*a* and gaps 3*b* to form decking 3 across joists. A rail cap 8 positioned on rail posts 5 and vertical pickets 6 define the perimeter of the deck 1 creating the deck area 2. Although not shown, additional horizontal members 7 may be affixed to the outer joists and or the pickets for added strength. As illustrated in FIGS. 2-10, it is an object of the invention to disclose a system allowing for enclosure of a deck 1 similar to that disclosed in FIG. 1 without regard to the deck area 2 or the outline of the perimeter formed by the rail cap 8. As will be discussed herein, one of ordinary skill will appreciate that the deck curtain system 10 and its method of use will vary from that shown in FIG. 1 without departure from the spirit and intent of the invention disclosed herein.

Figure 2:
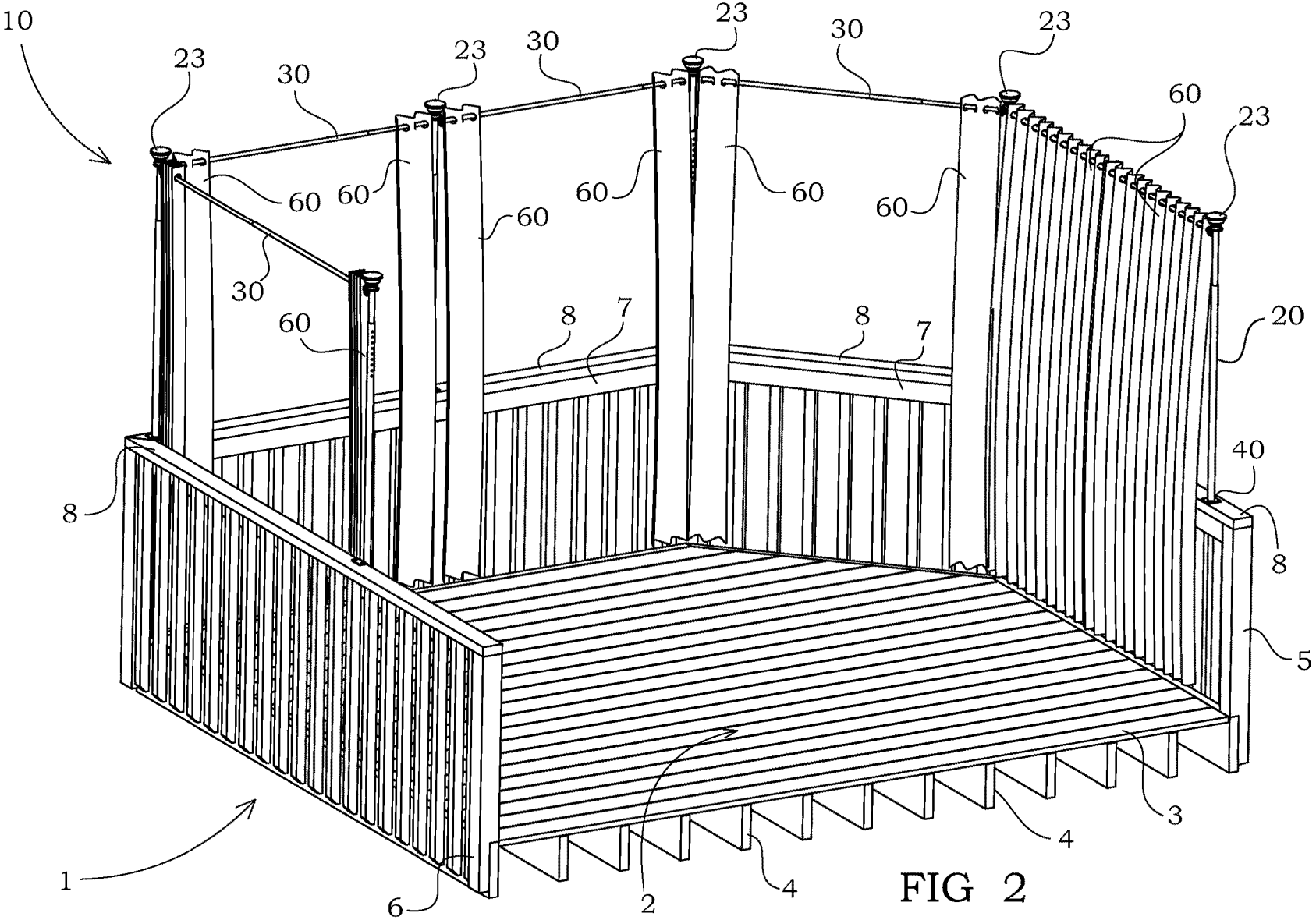
FIG. 2 is perspective overview of one embodiment of the deck curtain system 10 disclosed enclosing a deck 1 with a set of curtains around an exterior deck.
Figure 2A:
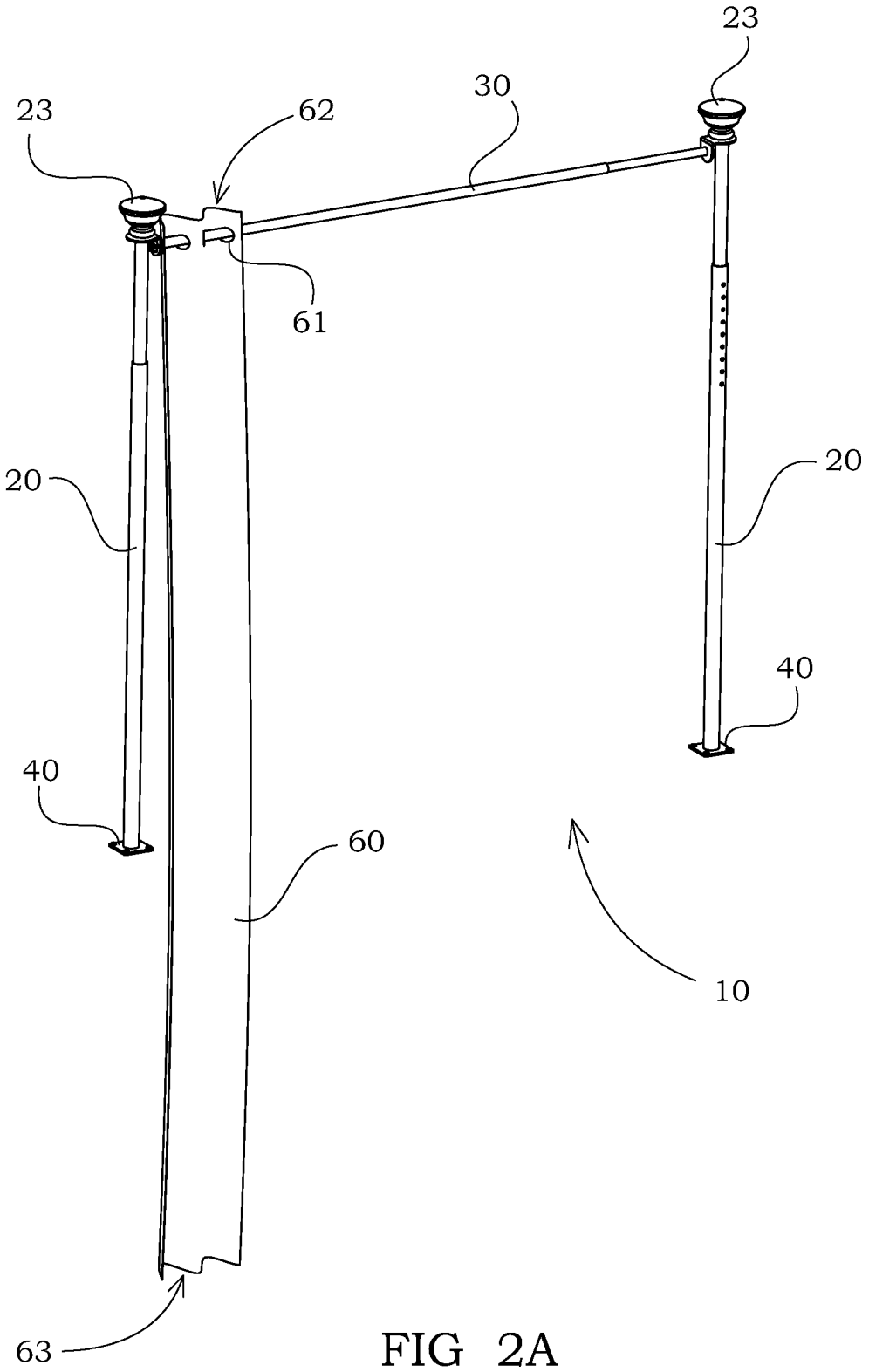
FIG. 2A is a perspective view of one section of the deck curtain system as implemented to a deck rail cap 8 surrounding a deck 1.

FIG. 2 is perspective overview of one embodiment of the deck curtain system 10 disclosed enclosing a deck 1 with a set of curtains 60 around an exterior deck area 2. As shown, the deck curtain system 10 is comprised of a combination of vertical posts 20 attached to the rail cap 8 of the deck 1, via attachment bases 40, with horizontal cross bars 30 positioned between the upper portion of the vertical posts 20 upon which the curtains 60 may be hung. FIG. 2A is a perspective view of one section of the deck curtain system 10 as implemented to a deck rail cap 8 surrounding a deck 1. As disclosed, the deck curtain system 10 has an approximate total height of 6-9 feet to provide privacy and/or sun and wind protection as may be desirable to the user of the deck 1. One of ordinary skill will appreciate that the deck curtain system 10 may be configured with vertical posts 20 having other dimensions and/or additional size or heights as desirable. Accordingly, curtain 60 may have a top 62 and a bottom 63 as shown as well as a entry-sleeve 61 which the cross member 30 may enter to support the curtain 60 when hung between the vertical posts 20. One of ordinary skill will appreciate that the embodiment of the curtain 60 shown through-out the various FIGS is for illustration only and variations in curtains dimensions, curtain type as well as entry-sleeve configurations herein will be obvious to those of ordinary skill in the arts without departure from the spirit and intent of the invention disclosed herein.

Figure 3:
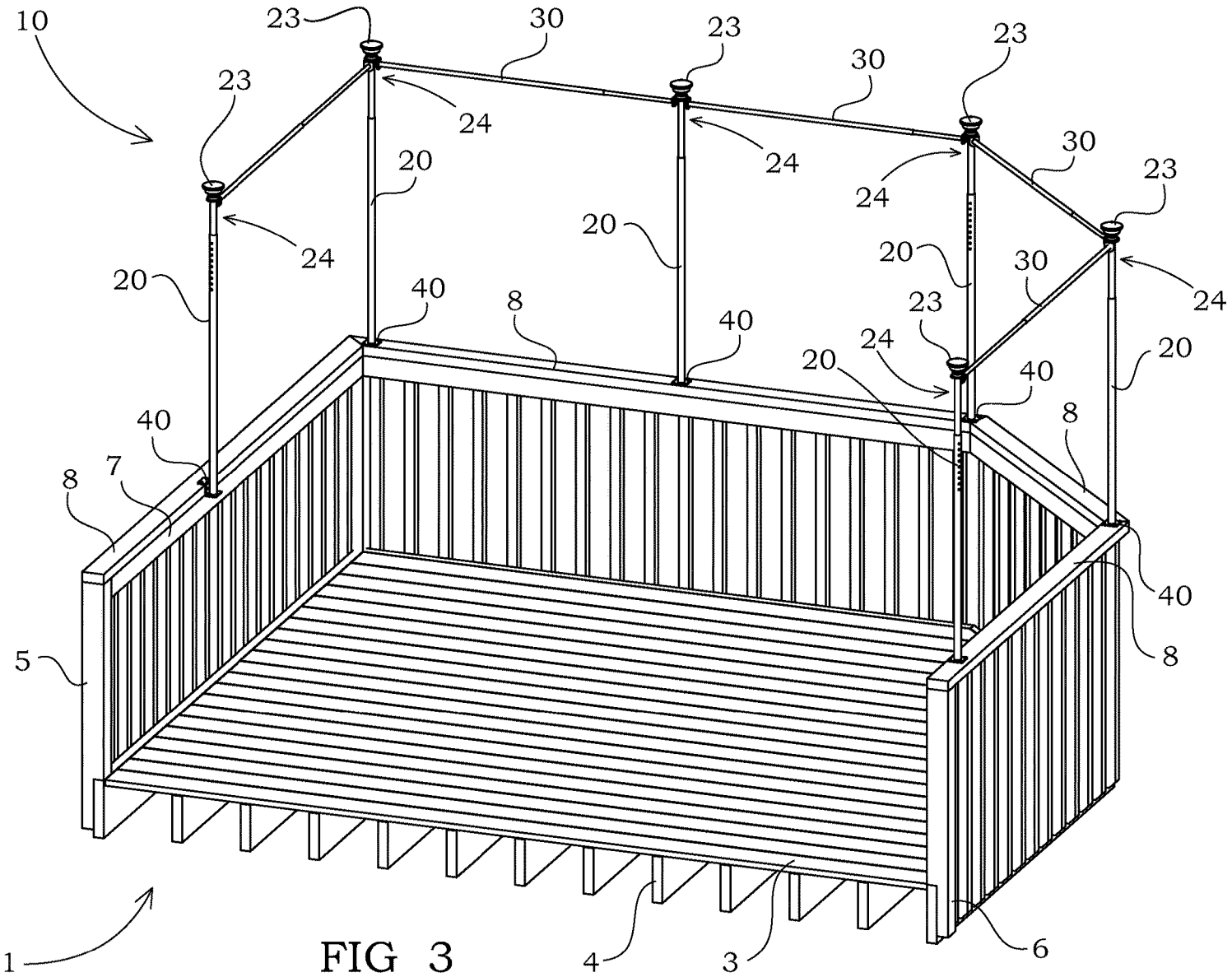
FIG. 3 is perspective view of FIG. 2 with the curtains removed to better illustrate the structural components of the deck curtain support structural components used to surround the exterior deck.

FIG. 3 is perspective view of FIG. 2 with the curtains 60 removed to better illustrate the structural components of the deck curtain support structural components used to surround the exterior deck.

Figure 4:
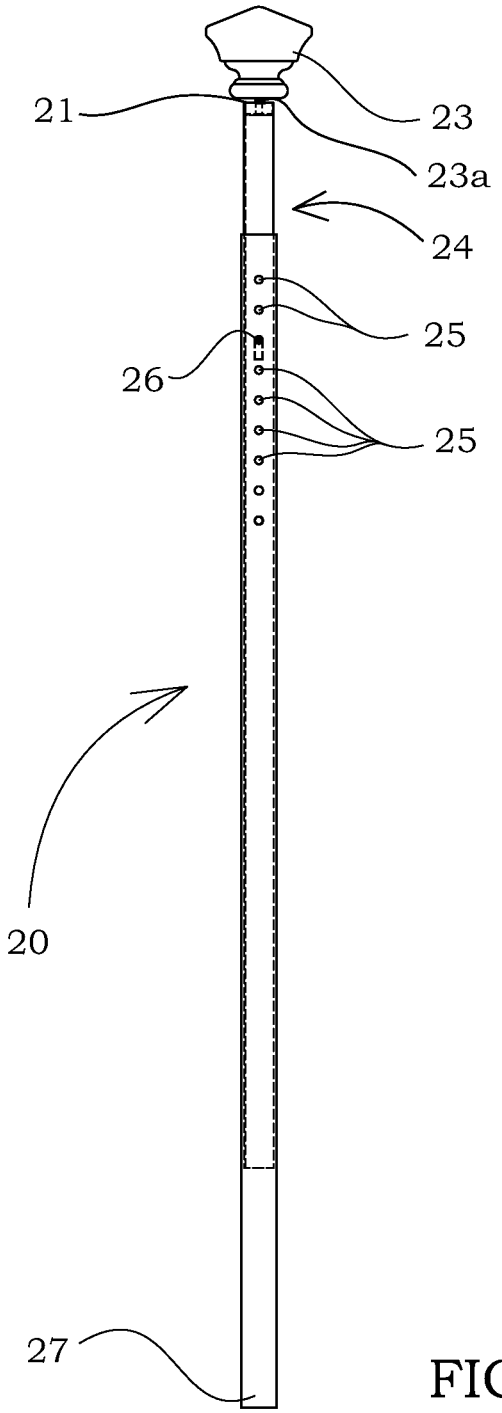
FIG. 4 is a detailed view of one illustrative embodiment of a vertical post 20 of the deck curtain system 10 disclosed herein.
Figure 4A:
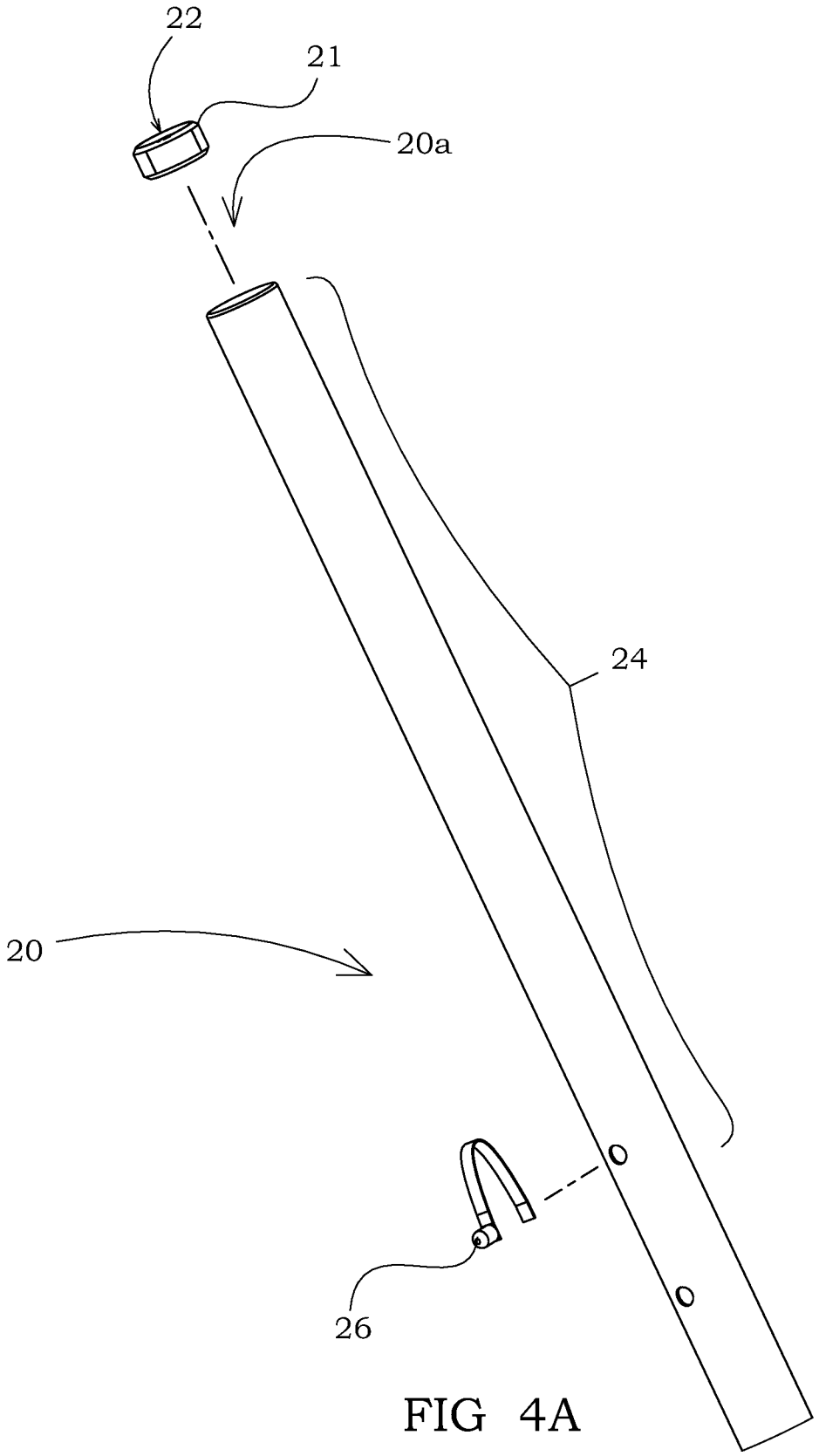
FIG. 4A is a detailed view of the end of the vertical post 20 with the finial 23 removed.

FIG. 4 is a detailed view of one illustrative embodiment of a vertical post 20 of the deck curtain system 10 disclosed herein. FIG. 4A is a detailed view of the end of the vertical post 20 with the finial 23 removed. As shown in the preceding figures, the vertical post 20 may be configured with an open end 20*a* and base end 20*b*. An end cap 21 having an opening, which may be threaded, 22 may be affixed in open end 20*a*. A finial 23, having a threaded post 23*a*, and an upper body portion having a size or shape, may be affixed to the upper most portion of the vertical post for ornamental purposes, as shown. Further, as shown in FIGS. 4 and 4A, the vertical post 20 may configured with adjustable section 24 as a second end positioned in a main section 27. The vertical post may be configured for height adjustment via holes 25 positioned in the adjustable section 24 and main section 27 with a spring button latch 26 positioned therein. As is well known to one of ordinary skill, depressing spring button latch 26 at hole 25 in a first position allows the adjustable section 24 to slide out or in across the spring button latch 26 and to a new hole at a second or third position. (Not shown) One of ordinary skill will appreciate that the embodiment of the vertical post 20 shown at FIGS. 4 and 4A is discussed in detail herein for purposes of enablement and that variations of vertical posts 20 allowing height adjustment not shown herein will be obvious to those of ordinary skill in the arts without departure from the spirit and intent of the invention disclosed herein.

Figure 5:
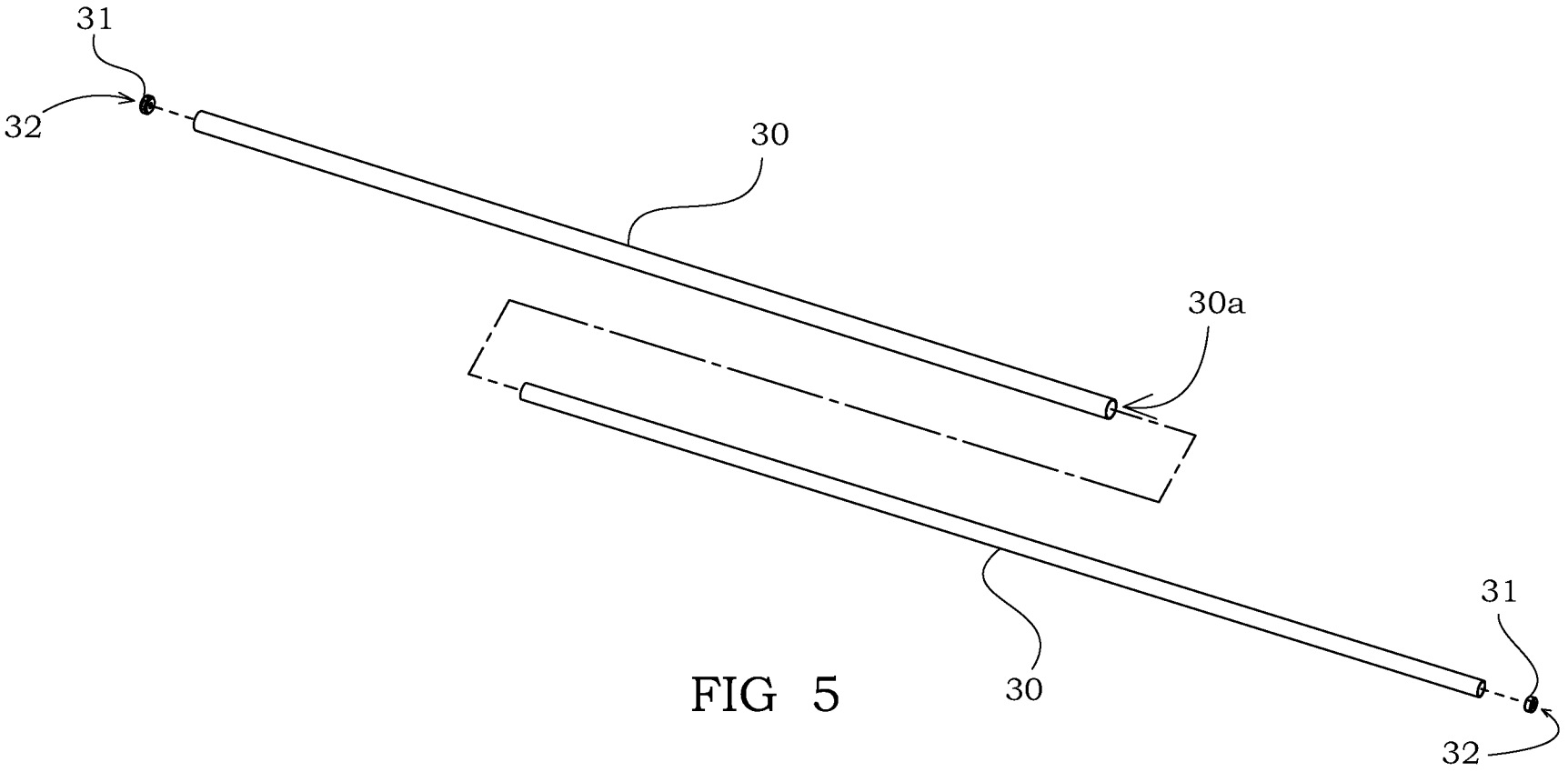
FIG. 5 is a detailed view of one illustrative embodiment of a horizontal rod 30 of the deck curtain system 10 disclosed herein.

FIG. 5 is a detailed view of one illustrative embodiment of a cross bar 30 of the deck curtain system 10 disclosed herein. Similar to vertical post 20, the cross bar 30 main body as shown is configured as hollow and having an open end 30*a* therein. An end cap 31 having a threaded opening may be positioned therein. FIG. 6 is a detailed view of another illustrative embodiment of a cross bar 30 having a center portion 32 allowing length adjustment via telescoping end sections 34 for use with the deck curtain system 10 disclosed herein. One of ordinary skill will appreciate that the embodiment of the cross member 30 shown at FIGS. 5 and 6 is discussed in detail herein for purposes of enablement and that variations of cross members 30 allowing length adjustment herein will be obvious to those of ordinary skill in the arts without departure from the spirit and intent of the invention disclosed herein.

FIG. 7 is a detailed view of one illustrative embodiment of a mounting base 40 which receives vertical post 20 and the rail cap 8 of the deck rail. FIG. 7A is a detailed view of the embodiment of FIG. 7 attached to the rail cap 8. As shown, the mounting base 40 has a receiver 41 which accepts the end of the vertical post 20, allowing it slide down over and cover the receiver 41. Various openings 41*a* are configured therein to allow attachment to the top and face surfaces of the rail cap 8 via fasteners 48. As shown, the base 42 of this embodiment is attached to a hanger 43 having a vertical section 43*a* and a horizontal shelf 43*b*, both of which are configured with openings 41*a* for fasteners 48.

FIG. 8 is a detailed view of another illustrative embodiment of a mounting base 40 for use with vertical post 20 and the rail cap of the deck rail. FIG. 8A is a detailed view of the embodiment of FIG. 8 attached to the rail cap 8. In this embodiment, the base 42 of the attachment base 40 is affixed directly to the rail cap, without hanger 43. One of ordinary skill will appreciate that the embodiments of the mounting base shown herein are for purposes of enablement and that variations of mounting bases 40 allowing either direct attachment to the top surface of the rail cap 8 or hung attachment via the top surface and face of the rail cap 8 herein will be obvious to those of ordinary skill in the arts without departure from the spirit and intent of the invention disclosed herein. The various configurations of the mounting base 40 disclosed in FIGS. 7, 7A, 8 and 8A, allow placement and attachment of the vertical posts 20 in support of installing and using the deck curtain system 10 disclosed herein. As shown in FIG. 24, one of ordinary skill will appreciate curtain system 10 may be used with mounting bases 40 and self-supporting weighted base 9 as suitable for a particular application, without limitation or restriction.

FIG. 9 is a perspective view of one illustrative embodiment of a horizontal connector 50 useful in connecting in multiple sections of horizontal orientated cross bars 30 to vertical posts 20 to support the deck system 10 and curtain 60 positioned therein. Proper installation of a deck curtain system 10 onto a pre-existing deck, having any size or shape, requires the deck curtain system 10 and its components to be adjustable in height and length. The horizontal connector 50 provides a connection point between the vertical posts 20 and the horizontal cross members 30 that allows for angled variation and support of the curtain 60 hung from cross members 30 therein.

FIG. 9A is an exploded view of the horizontal connector 50 of FIG. 9 and FIG. 9B is a detailed view of horizontal connector 50 of FIG. 9. As shown, the horizontal connector 50 is comprised of a mount 51 and a flap 52, each having apertures positioned therein, 51*a* and 52*a*, respectively, which may be threaded, as shown. During assembly, and as shown, knob 54 having threaded shaft 54*a* therein may be inserted into and cooperatively engaged with the end of the cross member 30 via the aperture 52*a* in flap 52 to affix the horizontal connector 50 to cross member 30. Then mount 51 may be placed flat upon the end cap of the vertical post with the threaded post of finial 23 inserted into the end cap through aperture 51*a* of mount 51 to affix the horizontal connector to the vertical post 20. Mount 51 is sufficiently sized to position flap 52 a sufficient distance away from the vertical post 20 to allow knob 54 to be accessible and usable therein without interference with vertical post 20.

FIG. 10 is a perspective view of the top portion of a vertical post 20 having a pair of horizontal connectors 50 engaged therein. FIG. 10A is a top view illustrating how multiple horizontal connectors 50 may be positioned upon the upper portion of the vertical post 20. In this way, a single type of vertical post 20, in combination with one horizontal connector 50 can serve as an end post (i.e. connected to only one cross member 30) or an adjacent post (i.e. connected to multiple cross members 30) via multiple horizontal connectors 50. Based on the proceeding figures, one of ordinary skill will appreciate that loosening the finial 23 releases the pressure on mount 51 of horizontal connector 50 allowing it to rotate in relation to vertical post 20 by comparing the position of cross member 30 to 30' and horizontal connector 50 to 50' as illustrated by FIG. 10A. Tightening finial 23 increases the pressure on mount 51 of horizontal connector 50 fixing its position in relation to vertical post 20. In this way, the horizontal connector 50 allows the deck curtain system 10 disclosed to fit or adjust to any deck to which the deck system is to be attached the perimeter of any deck as illustrated by FIG. 3 which clearly shows the deck perimeter having one ninety-degree angle as well as a pair of 45 degree angles.

FIG. 11 is another embodiment of a horizontal connector 70 configured with a pocket 72 for enclosure and engagement with the knob 54 with threaded portion 54*a*. As illustrated in FIG. 11, the cross bar 30 is configured with an open end for attachment to a knob 54. One of the ordinary skill will appreciate that the embodiment of the cross bar 30 with one end attached to a knob 54 is just one type of cross bar 30 that may be positioned between vertical posts 30 to support hanging curtains with other embodiments not having knob 54 without departure from the scope of the present disclosure. FIG. 12 is another view of the embodiment of FIG. 11 illustrating rotating cross member 30 with knob 54 positioned in the pocket style horizontal connector 70 in the pocket portion 72 to tighten the curtain rod 30 to the pole 24 (not shown). One of ordinary skill will appreciate that knob 54 and pocket 72 should be shaped to allow nesting and engagement between the outer perimeter of knob 54*b* and the interior wall 72*c* of the pocket so that cross member 30 is supported and knob 54 is constrained thereby allowing the threaded portion 54*a* to rest in pocket slot 72*b* so that cross member 30 rotation (clockwise or counter-clockwise) forces movement along the threaded portion 54*a* resulting in tightening or loosening of cross member 30 positioned between horizontal connector 70 and the vertical post (s) 20 to which it is attached. Further, as shown in FIGS. 11 and 12, pocket 72 may be configured with an aperture allowing locking engagement between the pocket aperture 72*a* and a portion of the knob perimeter 54*b*. FIG. 13 is a bottom perspective view of the embodiment of FIG. 11 prior to insertion of the knob 54 into the pocket 72 of the horizontal connector 70. The knob 54 is positioned in the pocket 72. The knob threaded portion 54*a* is positioned between the knob 54 and the cross bar 30. At the bottom of the pocket 72, a pocket slot 72*a* is designed to fit a portion of the knob 54 in order to fix the knob 54 within pocket 72. FIG. 13A is an exploded view of pocket style horizontal connector 70 as illustrated in FIG. 13 engaged with pole 24 and cross member 30 via knob 54. As shown, the horizontal connector 70 is comprised of a pocket 72 and a mount having a mount aperture 71*a*, the finial 23 is positioned to thread through the mount aperture 71*a* to the pole 24. During assembly, and as shown, knob 54 having threaded shaft 54*a* therein is inserted into the end of the cross member 30 via the aperture 54*a*.

It will be readily apparent to one of ordinary skill the utility and benefit provided by the knob locking function of the pocket portion of the horizontal connector 70. Further, one of ordinary skill will appreciate that although not show, any knob 54 or horizontal connector pocket 72 shape that allows engagement and nesting may be selected that is suitable for a particular application. Further, one of ordinary skill will appreciate that although not show, any knob 54*b* perimeter or horizontal connector pocket aperture 72*a* shape that allows engagement and locking may be selected that is suitable for a particular application.

Further, based on the process of rotating the horizontal connector 50, one of ordinary skill will appreciate that horizontal connector 70 offers a similar benefit in that loosening the finial 23 reduces the pressure on mount 51 of horizontal connector 70 allowing it to rotate around the perimeter of the vertical post 20 in order to fit or adjust to any deck system. After adjusting the position of the horizontal connector 70 in relation to the vertical post 20, tightening the finial 23 will increase the pressure on mount 51 allowing it to fix the position of horizontal connector 70 in relation to vertical post 20. Also as shown in FIG. 12, multiple pocket style horizontal connectors 70 may be attached (stacked) to a single pole 24 to allow for attachment of multiple cross bars 30 at various positions around the perimeter of the pole 24.

FIG. 14 illustrates another embodiment of a horizontal connector (rosette) 80 allowing connection between a curtain rod 30 and a pole 24. Similar to the other embodiments of a horizontal connector disclosed herein, the rosette style horizontal connector 80 is adapted to be affixed to the end of the vertical post 20 via mount aperture 81*a* (as shown in FIG. 17). FIG. 15 is another view of the embodiment of FIG. 14 illustrating a single rosette style horizontal connector 80 attaching a single pole 20 to multiple curtain rods 30 at various positions around the perimeter of the pole 20 via horizontal connector 80. As shown, a plurality (10) of apertures 82*a* are positioned around the perimeter 82 of the horizontal connector 80. The apertures 82*a* configured for engagement with cross members 30 configured with hooked ends 38. FIG. 16 is a bottom perspective view of the embodiment of FIG. 14 with multiple curtain rods 30 attached around the perimeter of pole 24. FIG. 18 is a top view of the horizontal connector 80 of FIGS. 14-17 with hooked curtain rod ends 38 engaged therein. At the center of the horizontal connector 80, a mount aperture 81*a* is adapted for the attachment of the finial 23 to the vertical post 20. The rosette style horizontal connector 80 allows the deck curtain system 10 to fit multiple curtain cross bars 30 without limitation and without adjustment of finial 23.

As shown the hooked ends 38 have a bulbous tip 38*a* having a tapered end. As shown in FIG. 17 on the left side, tipping the cross member 30 up in relation to the horizontal connector 80 positions the tapered end of the bulbous tip in such a way as to minimize or reduce the cross-sectional diameter of the hooked end in relation to the cross sectional diameter of the aperture 82*a* thereby allowing the hooked end 38 to slide into and through the aperture 82*a*. Further, as illustrated in the side cutaway view of FIG. 17 on the right side, when the cross member 30 is level (parallel) as compared to the horizontal plane of the horizontal connector 80, the bulbous tip 38*a* prevents hooked end 38 of the cross members from disengaging with horizontal connector 80 as the diameter of the bulbous tip 38*a* is greater than the inner diameter of the aperture. One of ordinary skill will appreciate that any shape of the bulbous tip 38*a* that allows entry into the aperture of the horizontal connector 82*a* in a first position and locking of the hooked end 38 in the aperture 82*a* in a second position may be selected that is suitable for a particular application.

FIG. 19 curtain showing curtain stays 64. The curtain entry-sleeve 61 is positioned on one of the horizontal edges of the curtain 60 allowing the curtain 60 to affix to the cross bar 30 by sliding the cross bar 30 through the curtain entry-sleeve 61. Curtain stays 64 and 68 allow the user to adjust the curtains 60 as needed subject to the weather conditions and user needs.

FIG. 20 is a latch pin 90 positioned exterior of the aperture 25 in the wall of vertical post 20. The latch pin 90 is designed for fixing (locking) the position of the vertical post 20 bottom section 27 and the adjustable section 24 together. Latch pin 90 is intended to be inserted through the aperture 25 (exterior hole) in the wall of the bottom section 27 of vertical post 20 and pass through and engage with the inside hole 24*a* in adjustable section 24.

As shown in FIGS. 20 and 21, a user (not shown) first selects the height of the vertical post 20 they desire for use with the curtain system 10. Then the user aligns aperture 24*a* with an exterior hole 25 for that desired vertical post height by moving adjustable section 24 up and down with latch pin 90 positioned proximate exterior hole 25. As the two holes align, the horizontal force applied to cap 90*a* pushes tapered conical end 90*d* into and through the walls of bottom section 27 via aperture 25 then through the walls of adjustable section 24 via aperture 24*a*.

As one of ordinary skill will appreciate, the tapered end 90*d* improves alignment and ease of entry. Annular groove 90*c* having a reduced diameter allows low resistance entry and allows the user to "wiggle" the adjustable section 24 as the reduced diameter allows hole clearance which translates into vertical movement of the adjustable section 24. As the latching pin 90 is pushed in further, the tapered section between the first and second annular grooves (90*c*/90*b*) acts like a ramp to reposition and align the adjustable and bottom sections (24, 27) reducing lift by the user. Finally, second annular groove 90*b* is positioned so that it engages with and the inner apertures 24*a* rest against its surfaces with the adjacent ridge engaged with and the aperture 25 rest against its surfaces with end cap 90*a* just sticking out from the surface of the vertical post 20. See additional detail at FIG. 23. In FIG. 22 the latch pin 90 as positioned in FIG. 21 with vertical post 20 in the horizontal position as it is intended benefit of the design disclosed that engagement be tight enough that the latching pin does not fall out when horizontally positioned. FIG. 23 is a detailed figure of the latch pin 90 illustrating the design of the respective diameters of the first and second annular grooves (90*b*/90*c*). As shown, in one embodiment, the diameter of the inside hole 24*a* has a diameter nearly equivalent to the diameter of the tip 90*d* so that the conical tip 90*d* catches on the inner hole (24*a*) to prevent unintentional disengagement. FIG. 24 is a simple figure illustrating another embodiment of the deck curtain system 10 with vertical posts 30 positioned on a deck 1 and engaged with a self-supporting weighted base 9. In this embodiment, the mounts 40 can be secured with any type of fastener including concrete anchors to a patio or deck screws if a wooden deck. The weighted pole support floats on the deck surface 1 and has just a center hole to support the vertical pole 20 plumb.

Further, one of ordinary skill will appreciate that other methods and apparatus are suitable for mounting the deck curtain system as disclosed without limitation. As one of ordinary skill will appreciate the present disclosure is not limited by the means of construction or the materials chosen as any suitable materials, including plastic, steel or aluminum, and combinations therein may be used for construction and attachment of the deck curtain and supporting structure disclosed herein.

Further, the various components of the deck curtain system 10 including the vertical post 20 and cross-member 30 have diameter dimension in the range of 0.75-1.0 inch with the mounting base receiver 41 sized similarly to fit with the vertical post 20. Horizontal connector 50 is sized similarly to fit between vertical post 20 and cross member 30. In FIGS. 9-10, without limitation or restriction, mount 51 is sized to position flap 52 approximately 0.75 inches away from the vertical post 20 to allow knob 53 to be accessible and usable therein without interference with vertical post 20. The preceding dimensions are included for purposes of enablement and do not limit or restrict the breadth of the apparatus and method disclosed as one of ordinary skill will appreciate that the deck curtain and its method of use may be configured with any dimension suitable for a particular application without departure from the spirit and intent of the concepts disclosed herein.

It should be noted that deck curtain 10 and mounting structure are not limited to the specific embodiments pictured and described herein, but is intended to apply to all similar apparatuses and methods for providing the various benefits of those elements, which such benefits are explicitly and/or inherently disclosed herein. Modifications and alterations from the described embodiments will occur to those skilled in the art without departure from the spirit and scope of the deck curtain 10. Furthermore, variations and modifications of the foregoing are within the scope of the deck curtain and mounting system. It is understood that the deck curtain and mounting system as disclosed herein extends to all alternative combinations of one or more of the individual features mentioned, evident from the text and/or drawings, and/or inherently disclosed. All of these different combinations constitute various alternative aspects of the deck curtain and mounting system. The embodiments described herein explain the best modes known for practicing the deck curtain and mounting system and will enable others skilled in the art to utilize the same. The claims are to be construed to include alternative embodiments to the extent permitted by the prior art.

What is claimed is:

1. A hardware accessory allowing connections between members lying in different planes comprising:

a. a generally flat mount portion having an aperture positioned therein, wherein the aperture is adapted for engagement with the distal end of a first member having a body generally in a first plane; and, b. an engagement portion forming a pocket shaped to receive and partially enclose the distal end of a second member having a body generally in a second plane, wherein the mount portion and the engagement portion are generally transverse, wherein the distal end of the second member is configured as a knob to rest in the pocket shaped engagement portion; and wherein the engagement portion has a pocket aperture allowing locking engagement between the pocket aperture and a portion of the knob.

2. The hardware accessory according to claim 1 wherein the distal end of the second member is configured with a threaded portion, wherein the knob is positioned on the threaded portion and rotatable to allow the knob to move from a first position to a second position on the threaded portion of the second member.

3. The hardware accessory according to claim 2 wherein the engagement portion has a pocket slot allowing engagement with the second member.

4. The hardware accessory according to claim 3 wherein the engagement portion has a pocket aperture allowing locking engagement between the pocket aperture and a perimeter portion of the knob.

5. A hardware accessory allowing connections between members lying in different planes comprising:

a. a generally flat mount portion having an aperture positioned therein, wherein the aperture is adapted for engagement with the distal end of a first member having a body generally in a first plane; and, b. an engagement portion formed as a pocket having a front and rear wall shaped to receive and partially enclose the distal end of a second member having a body generally in a second plane, wherein the pocket extends axially down a portion of the length of the first member, wherein the mount portion and the engagement portion are generally transverse.

6. The hardware accessory according to claim 5 wherein the distal end of the second member is configured as a knob to rest in the pocket shaped engagement portion.

7. The hardware accessory according to claim 6 wherein the distal end of the second member is configured with a threaded portion, wherein the knob is positioned on the threaded portion and rotatable to allow the knob to move from a first position to a second position on the threaded portion of the second member.

8. The hardware accessory according to claim 7 wherein the engagement portion has a pocket slot allowing engagement with the second member.

9. The hardware accessory according to claim 8 wherein the engagement portion has a pocket aperture allowing locking engagement between the pocket aperture and a portion of the knob.

10. The hardware accessory according to claim 9 wherein the engagement portion has a pocket aperture allowing locking engagement between the pocket aperture and a perimeter portion of the knob.

* * * * *